US008381417B2

(12) United States Patent
Crowley, II et al.

(10) Patent No.: US 8,381,417 B2
(45) Date of Patent: Feb. 26, 2013

(54) ARTICLES OF FOOTWEAR

(75) Inventors: Kevin Crowley, II, Newbury, MA (US); David M. Nau, Wayland, MA (US); James Cheney, Northboro, MA (US); Matthew R. Clerc, Acushnet, MA (US); David Thorpe, Acton, MA (US)

(73) Assignee: SR Holdings, LLC, Lexington, MA (US)

( * ) Notice: Subject to any disclaimer, the term of this patent is extended or adjusted under 35 U.S.C. 154(b) by 728 days.

(21) Appl. No.: 12/540,504

(22) Filed: Aug. 13, 2009

(65) Prior Publication Data

US 2010/0071228 A1 Mar. 25, 2010

Related U.S. Application Data

(60) Provisional application No. 61/099,043, filed on Sep. 22, 2008.

(51) Int. Cl.
*A43B 13/28* (2006.01)
*A03B 13/18* (2006.01)

(52) U.S. Cl. ..... 36/28; 36/30 R; 36/35 R

(58) Field of Classification Search ..... 36/28, 25 R, 36/30 R, 35 R, 114, 27
See application file for complete search history.

(56) References Cited

U.S. PATENT DOCUMENTS

| | | | | |
|---|---|---|---|---|
| 4,535,553 | A * | 8/1985 | Derderian et al. | 36/28 |
| 4,536,974 | A * | 8/1985 | Cohen | 36/28 |
| 5,595,002 | A | 1/1997 | Slepian et al. | |
| 6,516,539 | B2 * | 2/2003 | Nishiwaki et al. | 36/28 |
| 6,625,905 | B2 * | 9/2003 | Kita | 36/30 R |
| 6,722,058 | B2 | 4/2004 | Lucas et al. | |
| 6,826,852 | B2 * | 12/2004 | Fusco | 36/103 |
| 6,860,034 | B2 * | 3/2005 | Schmid | 36/27 |
| 7,513,065 | B2 * | 4/2009 | Kita et al. | 36/27 |
| 7,624,515 | B2 * | 12/2009 | Kita et al. | 36/30 R |
| 7,707,743 | B2 * | 5/2010 | Schindler et al. | 36/28 |
| 7,886,461 | B2 * | 2/2011 | Sato | 36/27 |
| 2007/0240331 | A1 | 10/2007 | Borel | |
| 2008/0052965 | A1 | 3/2008 | Sato | |

FOREIGN PATENT DOCUMENTS

| | | |
|---|---|---|
| DE | 101 12 821 | 10/2004 |
| EP | 1 844 673 | 10/2007 |

OTHER PUBLICATIONS

Laure Acquaviva, "Notification of Transmittal of the International Search Report and the Written Opinion of the International Searching Authority, or the Declaration", International Application No. PCT/US2009/053656, mailed on Nov. 12, 2009 (13 pages).

* cited by examiner

*Primary Examiner* — Jila M Mohandesi
(74) *Attorney, Agent, or Firm* — Warner Norcross & Judd LLP

(57) ABSTRACT

An article of footwear includes a footwear upper and a sole assembly secured to the footwear upper. The sole assembly has a heelward portion and a toeward portion, and includes a deck assembly disposed substantially in the heelward portion of the sole assembly. The deck assembly includes an upper deck portion, a lower deck portion spaced from the upper deck portion, and right and left supports attached to respective right and left portions of the upper and lower deck portions substantially near respective right and left lateral edges of the upper and lower deck portions. The deck assembly defines a cavity between the upper and lower decks. The deck assembly directs translation of ground contact forces incurred by the heelward portion of the sole assembly at least partially laterally outwardly.

21 Claims, 31 Drawing Sheets

ARTICLES OF FOOTWEAR

CROSS REFERENCE TO RELATED APPLICATIONS

This U.S. patent application claims priority under 35 U.S.C. §119(e) to U.S. Provisional Application 61/099,043, filed on Sep. 22, 2008. The disclosure of this prior application is considered part of the disclosure of this application and is hereby incorporated herein by reference in its entirety.

TECHNICAL FIELD

This disclosure relates to articles of footwear.

BACKGROUND

In general, shoes, a type of articles of footwear, include an upper portion and a sole. When the upper portion is secured to the sole, the upper portion and the sole together define a void that is configured to securely and comfortably hold a human foot. Often, the upper portion and/or sole are/is formed from multiple layers that can be stitched or adhesively bonded together. For example, the upper portion can be made of a combination of leather and fabric, or foam and fabric, and the sole can be formed from at least one layer of natural rubber. Often materials are chosen for functional reasons, e.g., water-resistance, durability, abrasion-resistance, and breathability, while shape, texture, and color are used to promote the aesthetic qualities of the shoe.

SUMMARY

In one aspect, an article of footwear includes a footwear upper and a sole assembly secured to the footwear upper. The sole assembly has a heelward portion and a toeward portion, and includes a deck assembly disposed substantially in the heelward portion of the sole assembly. The deck assembly includes an upper deck portion, a lower deck portion spaced from the upper deck portion, and right and left supports attached to respective right and left portions of the upper and lower deck portions substantially near respective right and left lateral edges of the upper and lower deck portions. The deck assembly defines a cavity between the upper and lower decks. The deck assembly directs translation of ground contact forces incurred by the heelward portion of the sole assembly at least partially laterally outwardly. The cavity or void defined by the deck between the upper and lower deck portions prevents or substantially inhibits direct translation of vertical forces between the two deck portions. This may isolate a user's heel from experiencing direct ground contact forces and shocks while donned on the user's foot. Instead, ground contact forces are redirected laterally to the right and left side supports, which are offset from the heel of a received foot (e.g., the right and left supports are not directly below the center of the received heel). As a result, ground contact forces directly below the received heel are not directly translated to the heel, thus reducing a user's experience of shock and vibration from a moving surface, such as the deck of a boat, construction vehicle, large machinery, etc. In some implementations, the sole assembly includes an outsole and a midsole disposed on the outsole in at least the forefoot portion of the sole assembly. The outsole and midsole may be configured to provide further dampening and shock absorption of the sole assembly, as by material selection.

Implementations of the disclosure may include one or more of the following features. In some implementations, the right and left supports are attached to the respective right and left portions of the upper and lower deck portions substantially near respective toeward portions of the upper and lower deck portions. The sole assembly, in some examples, includes an outsole and a first midsole disposed on the outsole in at least the forefoot portion of the sole assembly. The deck assembly is disposed on the outsole in at least the heelward portion of the sole assembly substantially in between the outsole and the first midsole. The outsole may be configured to support at least a portion of the right and left portions of the upper deck portion substantially near respective right and left lateral edges of the upper deck portion. In some implementations, the sole assembly includes a second midsole disposed between the upper and lower deck portions substantially about the cavity defined therebetween. The second midsole can be as compliant or more compliant than the first midsole. In some examples, the first midsole comprises a shock absorbing polyurethane; however other materials may be used as well, such as ethylene vinyl acetate. The first midsole has a durometer of between about 40 Asker C and about 70 Asker C. In some implementations, the deck assembly includes a rear support attached to a heelward portion of the upper deck portion and a heelward portion of the lower deck portion.

In some implementations, the sole assembly includes an outsole and a midsole disposed on the outsole in at least the forefoot portion of the sole assembly. The deck assembly is disposed on the midsole in the heel portion of the sole assembly. The midsole is configured to support at least a portion of the right and left portions of the upper deck portion substantially near respective right and left lateral edges of the upper deck portion. The midsole defines a depression configured to receive the lower deck portion, while at least partially supporting toeward and heelward portions of the upper deck portion.

In some examples, the upper deck portion defines an arcuate shape (e.g. concave facing downwardly toward the lower deck portion). The right and left supports may define curved shapes, substantially step-profiled shapes or other suitable shapes. The deck may comprise thermoplastic polyurethane and/or have a durometer of between about 40 Shore D and about 70 Shore D preferably 60 Shore D. In some examples, the sole assembly includes an outsole that supports the deck assembly and defines a siped bottom surface. The outsole may comprise a rubber compound including isobutylene rubber, butadiene rubber, styrene butadiene rubber, and/or natural rubber.

The shoe may define a toe spring of between about 1 mm and about 20 mm, preferably about 15 mm, which aids stability of the shoe on moving surfaces by allowing a user to more easily press the toe box of the shoe downward onto the moving surface.

In another aspect, a sole assembly for an article of footwear includes an outsole having a heelward portion and a toeward portion, a first midsole disposed on the outsole in at least the toeward portion of the outsole, and a deck assembly disposed in the heelward portion of the sole assembly between the outsole and the first midsole. The deck assembly includes upper and lower deck portions, and a second midsole disposed between the upper and lower deck portions. The second midsole defines a cavity for substantially inhibiting translation of ground contact forces directly between the upper and lower deck portions, the second midsole at least partially supporting the upper deck portion.

Implementations of this aspect of the disclosure may include one or more of the following features. In some implementations, the sole assembly includes right and left supports attached to respective right and left portions of the upper and lower deck portions substantially near respective right and left lateral edges of the upper and lower deck portions. The right and left supports may be attached to the respective right and left portions of the upper and lower deck portions substantially near respective toeward portions of the upper and lower deck portions. The deck assembly may include a rear support attached to a heelward portion of the upper deck portion and a heelward portion of the lower deck portion. In some examples, the second midsole is more compliant than the first midsole, which may comprises a shock absorbing polyurethane or ethylene vinyl acetate. The deck assembly may comprise a thermoplastic polyurethane.

In another aspect, a sole assembly, having a heelward portion and a toeward portion for an article of footwear, includes an outsole having a heelward portion and a toeward portion, a midsole disposed on the outsole in at least the toeward portion of the outsole, and a deck assembly disposed in the heelward portion of the sole assembly. The deck assembly includes an upper deck portion, a lower deck portion vertically spaced below the upper deck portion, and right and left supports attached to respective right and left portions of the upper and lower deck portions substantially near respective right and left lateral edges of the upper and lower deck portions. The deck directs translation of ground contact forces incurred by the heel portion of the sole assembly at least partially laterally outwardly. In some implementations, a cavity or void defined between the upper and lower deck portions prevents or substantially inhibits direct translation of vertical forces between the two deck portions. This may isolate a user's heel from experiencing direct ground contact forces and shocks while donned on the user's foot. Instead, ground contact forces are redirected laterally to the right and left side supports, which are offset from the heel of a received foot (e.g., the right and left supports are not directly below the center of the received heel). As a result, ground contact forces directly below the received heel are not directly translated to the heel, thus reducing a user's experience of shock and vibration from a moving surface, such as the deck of a boat, construction vehicle, large machinery, etc. In some implementations, the sole assembly includes an outsole and a midsole which may be configured to provide further dampening and shock absorption of the sole assembly, as by material selection.

In yet another aspect, a sole assembly for an article of footwear includes an outsole having a heelward portion and a toeward portion, a midsole disposed on the outsole in the toeward portion of the outsole, and a deck disposed on the outsole above the heel portion of the outsole and below the midsole. The deck includes an upper deck portion defining an arcuate shape and a lower deck portion having right and left portions secured to respective right and left portions of the upper deck portion, defining a cavity therebetween. The deck directs translation of ground contact forces incurred by the heel portion of the sole assembly at least partially laterally outwardly. For example, the curved upper deck portion pushes or deflects laterally outwardly while experiencing vertical loads.

The details of one or more implementations of the disclosure are set forth in the accompanying drawings and the description below. Other aspects, features, and advantages will be apparent from the description and drawings, and from the claims.

Like reference symbols in the various drawings indicate like elements. By way of example only, all of the drawings are directed to an article of footwear and sole assembly suitable to be worn on a left foot. The invention includes also the mirror images of the drawings, i.e. an articles of footwear and sole assemblies suitable to be worn on a right foot.

DETAILED DESCRIPTION

Shock and vibrations forces experienced while boating, in particular power boating, typically causes fatigue and even muscle soreness. A person can experience forces, translated from a power boat deck, several times that of running. A reduction in the shock forces and vibrations experienced while boating typically enhances the boating experience. In the past, some people have chosen to wear running shoes while boating; however, some traditional running shoes have been found to amplify the forces experienced while boating, due to their rebound properties chosen to aid forward propulsion while running. Other people have chosen to go barefoot while boating; however, this offers no reduction in the shock and vibrations forces experienced. The present disclosure provides a sole assembly, and, in some examples, a shoe that reduces the shock and vibrations forces experienced while boating, thereby likely reducing fatigue and enhancing enjoyment of boating.

Figure 1A:
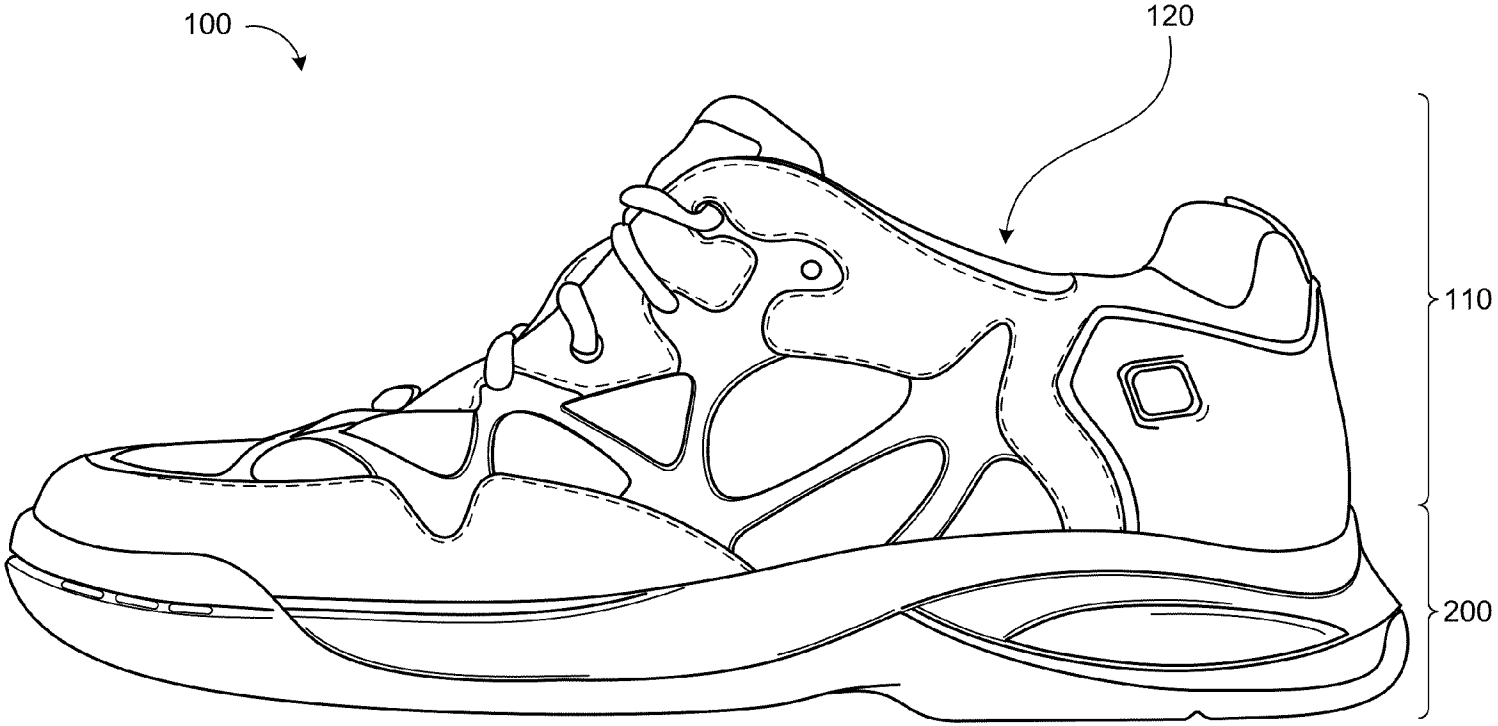
FIG. 1A is an elevated perspective view of a left article of footwear having a sole assembly.
Figure 1B:
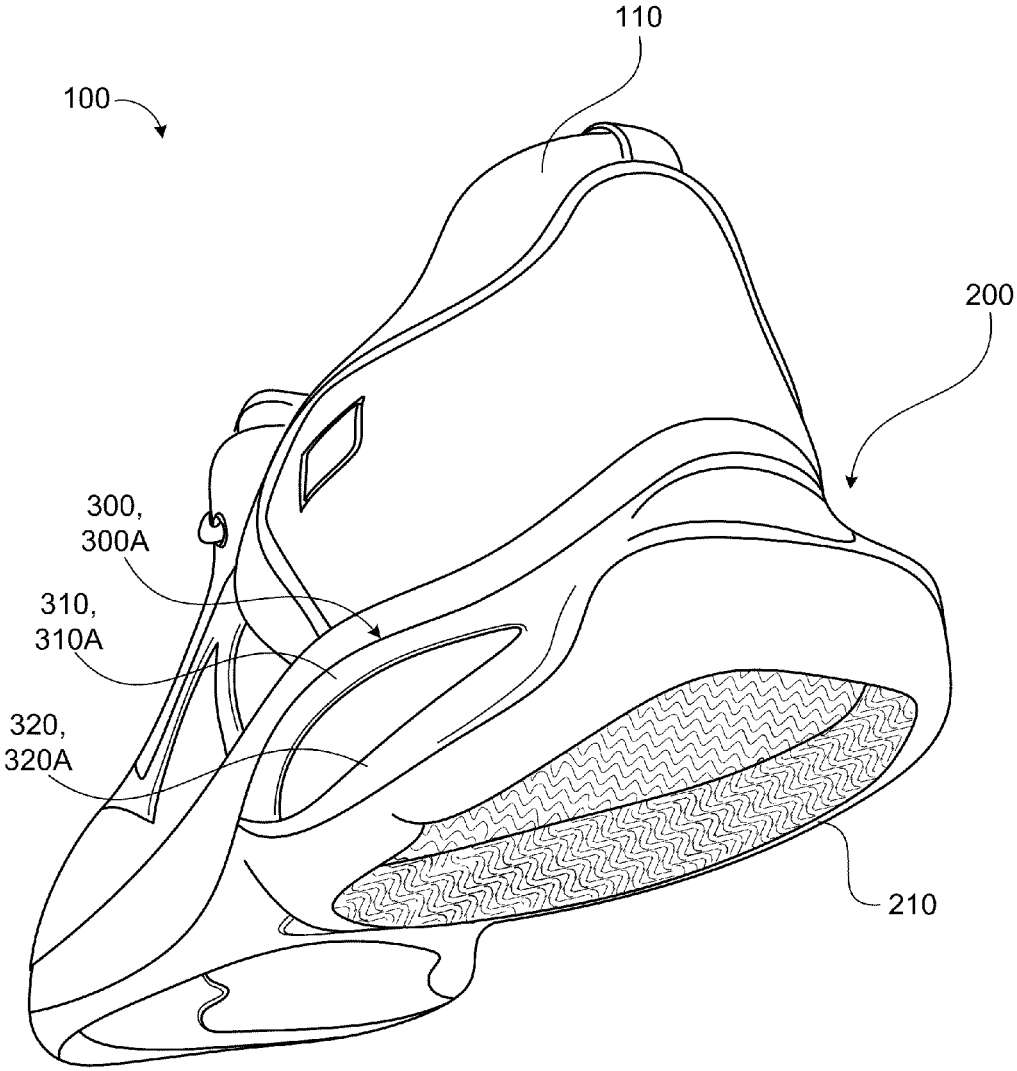
FIG. 1B is a side view of a left article of footwear having a sole assembly.

Referring to FIGS. 1A and 1B, a shoe 100 includes a shoe upper 110 and a sole assembly 200 secured to the shoe upper 110. The shoe upper 110 and the sole assembly 200 together define a void 120 configured to securely and comfortably hold a human foot. Although a shoe 100 is shown, the sole assembly 200 may be used for other types of articles of footwear, including, but not limited to boots, sandals, flip-flops, etc.

FIGS. 2A-3M provide a preferred implementation of the sole assembly 200, 200A. FIGS. 4A-5M show two alternative implementations of the sole assembly 200, 200B, 200C. FIGS. 3A-3D, 4A-4D, and 5A-5D show front, rear, and side views of each respective implementation of the sole assembly 200, 200A, 200B, 200C. The sole assembly 200 has a heel portion 202 and a forefoot portion 204, and includes an outsole 210, a midsole 220, and a deck assembly 300, which has upper and lower portions 310, 320. The outsole 210 has a heel portion 212 and a forefoot portion 214 corresponding to the heel portion 202 and the forefoot portion 204 of the sole assembly 200. The sole assembly 200 substantially redirects ground contact forces incurred in at least the heel portion 202 of the sole assembly 200 to right and/or left lateral edge portions of the sole assembly 200. Preferably, the deck assembly 300 prevents direct translation of ground contact forces incurred in at least the heel portion 202 of the sole assembly 200 to a user's heel and substantially redirects the forces to right and/or left lateral edge portions of the sole assembly 200. FIGS. 2A-2D provide assembled, partially exploded, and fully exploded views of one implementation of the sole assembly 200.

The deck assembly 300 redirects ground contact forces incurred in at least the heel portion 202 of the sole assembly 200 to right and/or left lateral edge portions of the sole assembly 200. A cavity or void defined by the deck assembly 300 between the upper and lower portions 310, 320 prevents or substantially inhibits direct translation of vertical forces between the two deck portions 310, 320. This may isolate a user's heel from experiencing direct ground contact forces and shocks while donned on the user's foot. Instead, ground contact forces are redirected laterally to the right and/or left lateral edge portions of the sole assembly 200, which can be offset from the heel of a received foot (e.g., the right and left supports are not directly below the center of the received heel). As a result, ground contact forces directly below the received heel are not directly translated to the heel, thus reducing a user's experience of shock and vibration from a moving surface, such as the deck of a boat, construction vehicle, large machinery, etc. The deck assembly 300 can be formed of a thermoplastic polyurethane. The deck assembly 300 has a durometer of between about 40 Shore D and about 70 Shore D (preferably 60 Shore D). Preferably, the deck material is more rigid than the outsole 210 and the midsole 220.

Figure 3A:
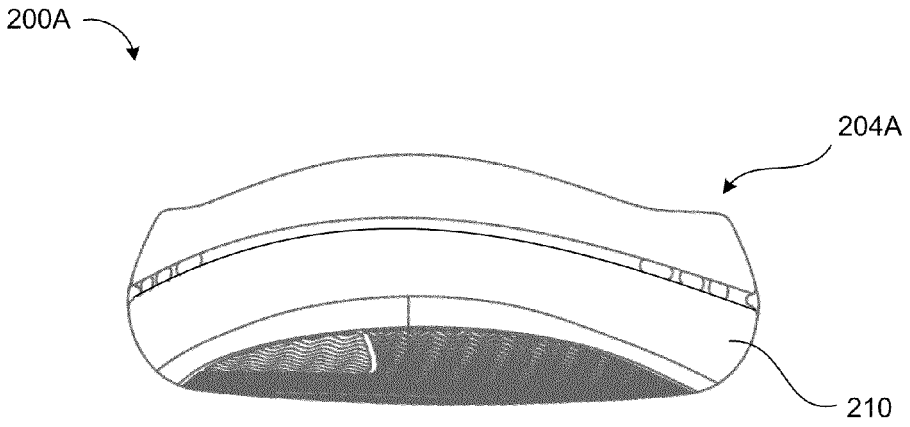
FIG. 3A is a front view of a sole assembly.
Figure 3B:
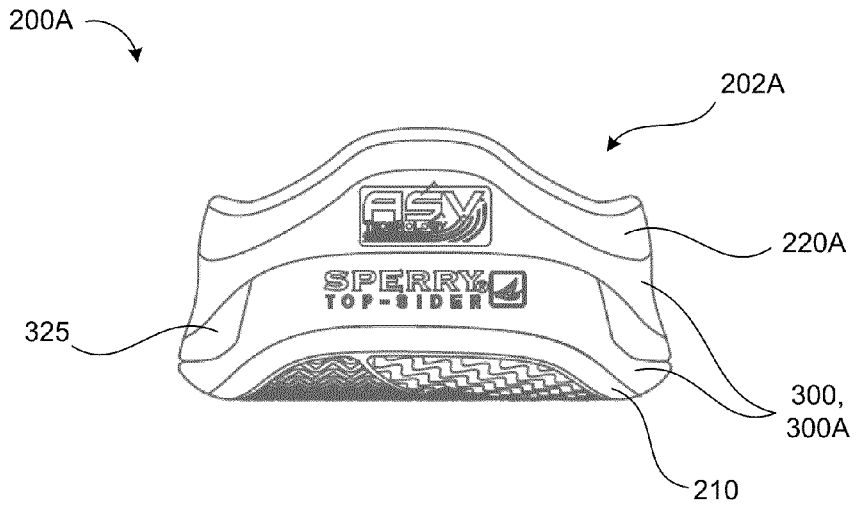
FIG. 3B is a rear view of a sole assembly.
Figure 3C:
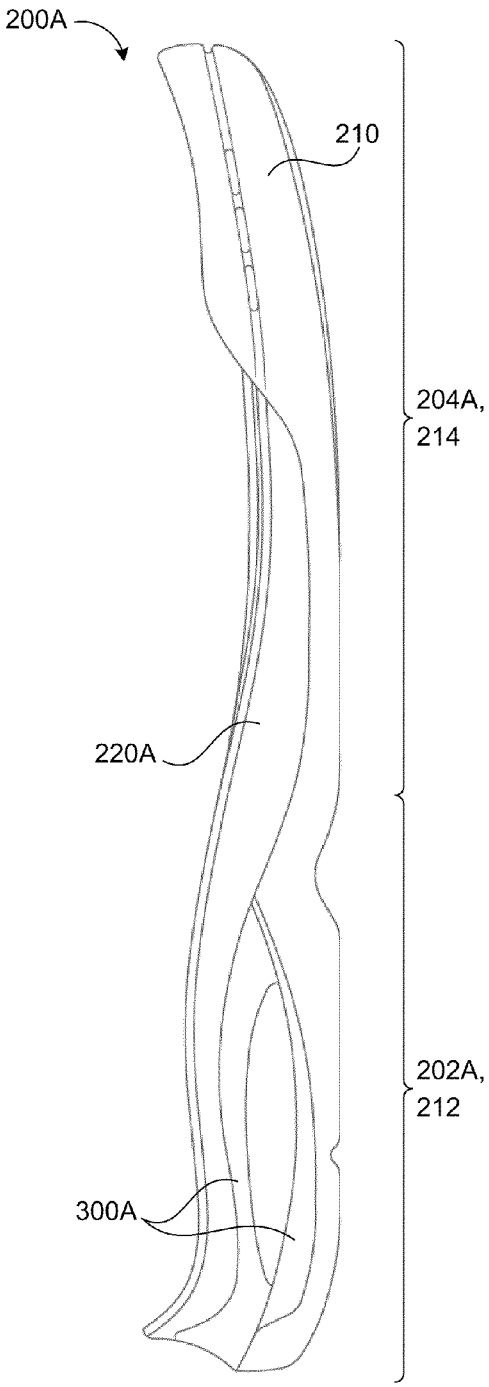
FIG. 3C is a right side view of a sole assembly.
Figure 3D:
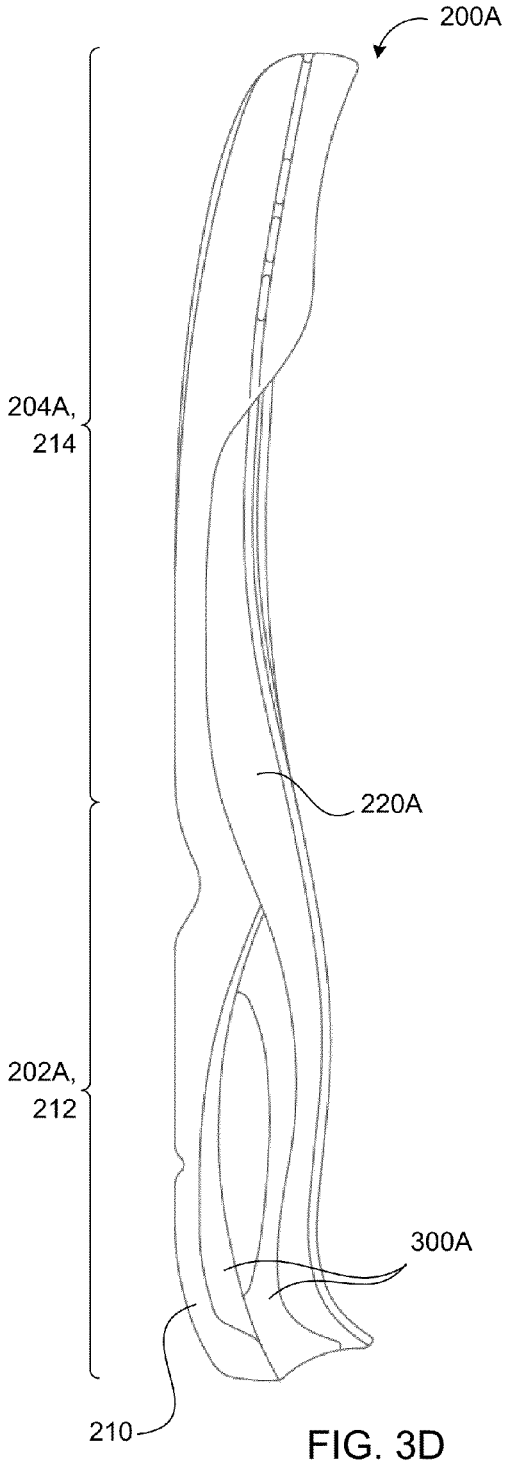
FIG. 3D is a left side view of a sole assembly.
Figure 3E:
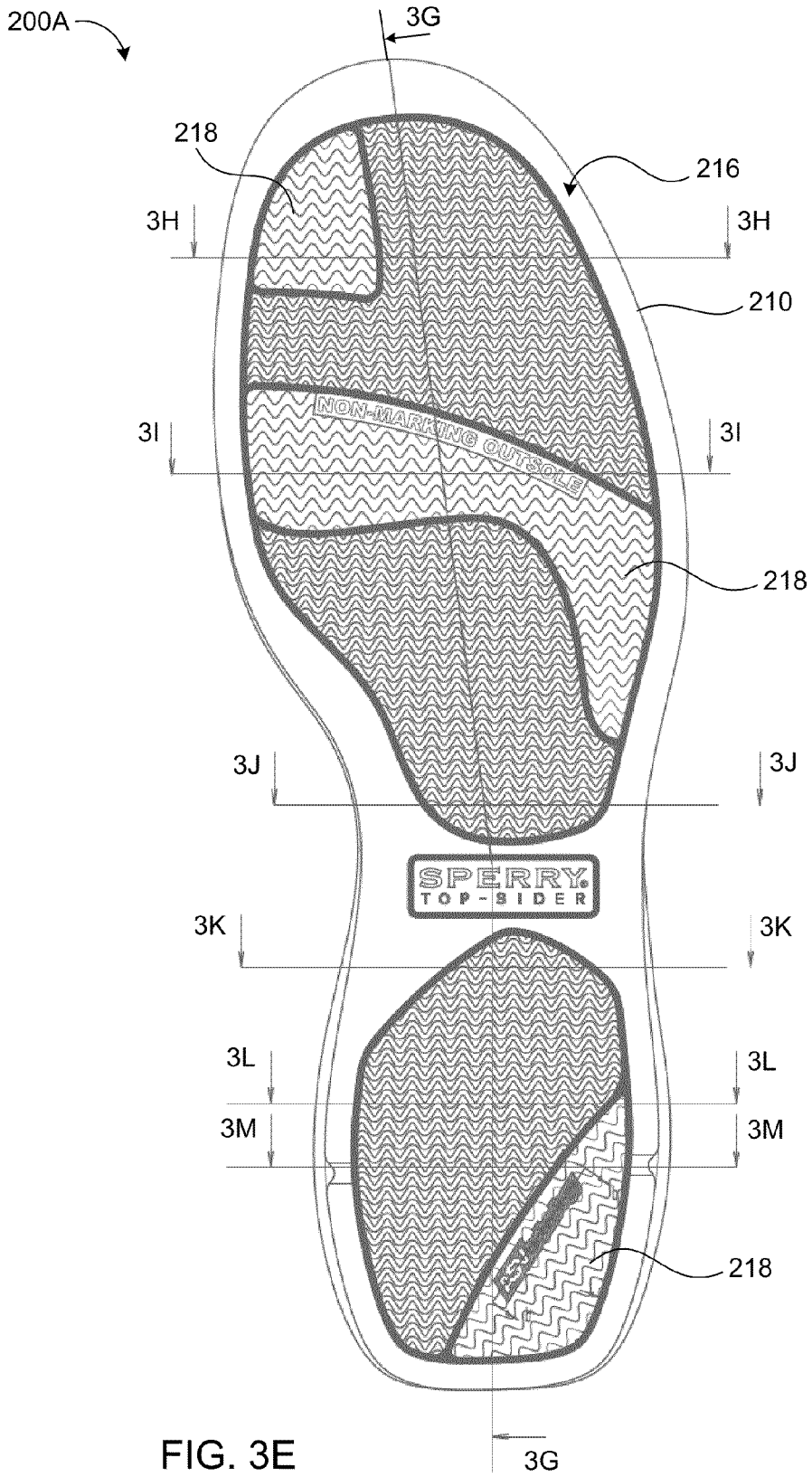
FIG. 3E is a bottom view of a sole assembly.
Figure 4G:
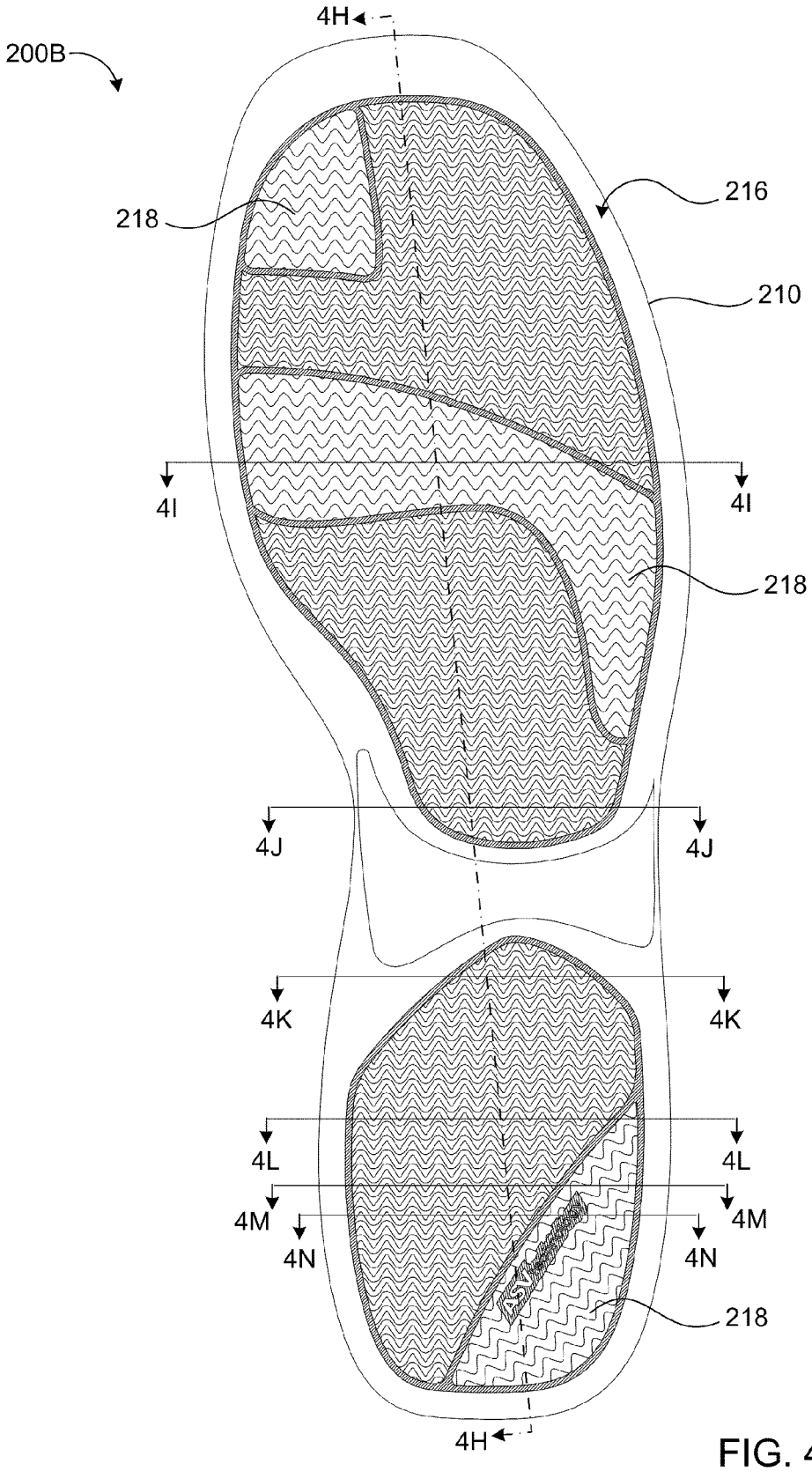
FIG. 4G is a bottom view of a sole assembly.
Figure 4H:
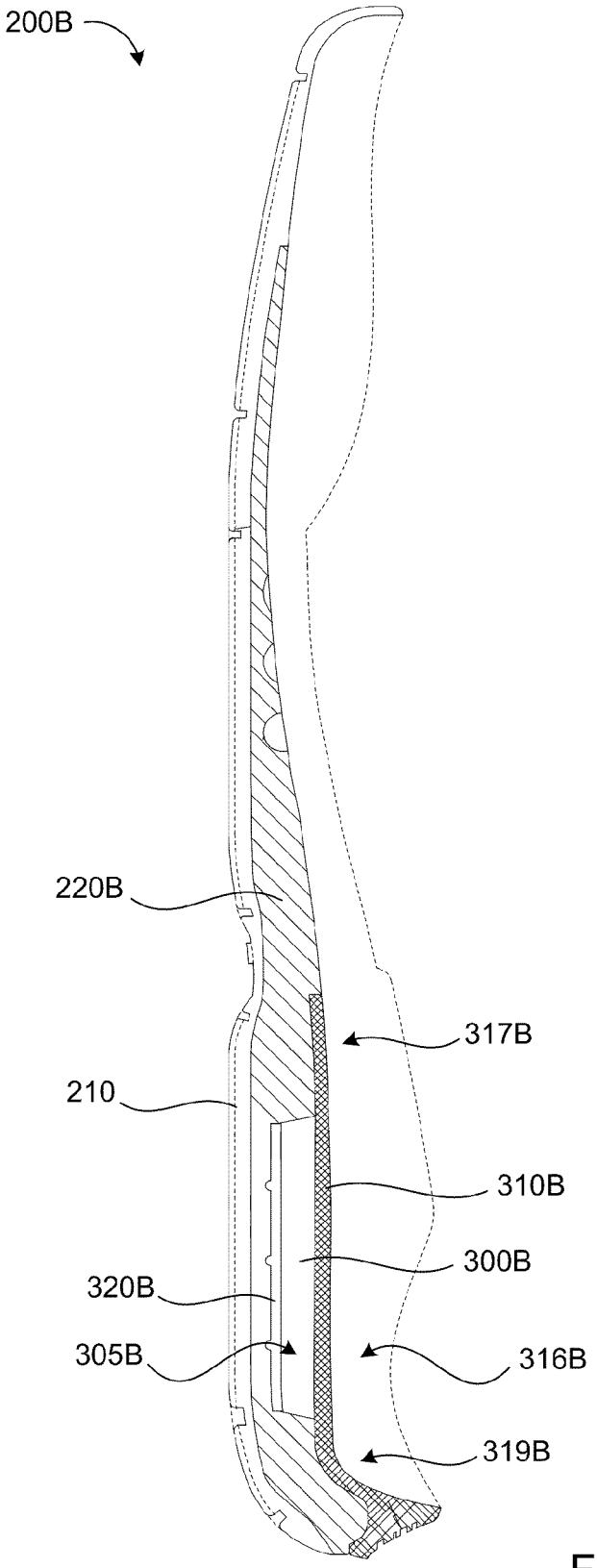
FIG. 4H is a section view of the sole assembly of FIG. 4G along line 4H-4H.
Figure 4I:
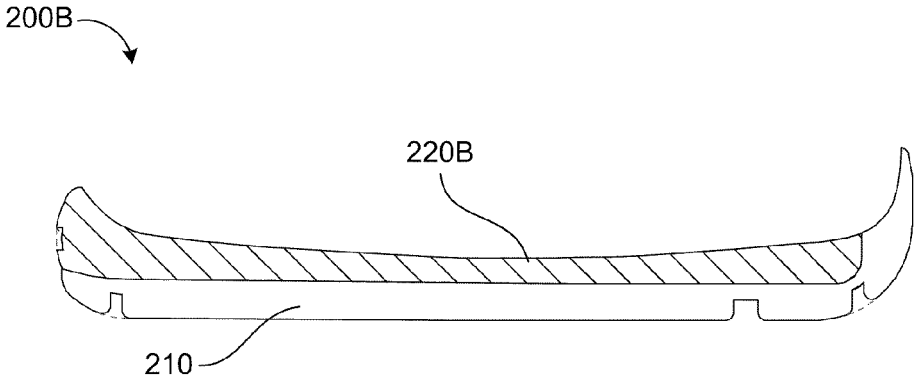
FIG. 4I is a section view of the sole assembly of FIG. 4G along line 4I-4I.
Figure 4J:
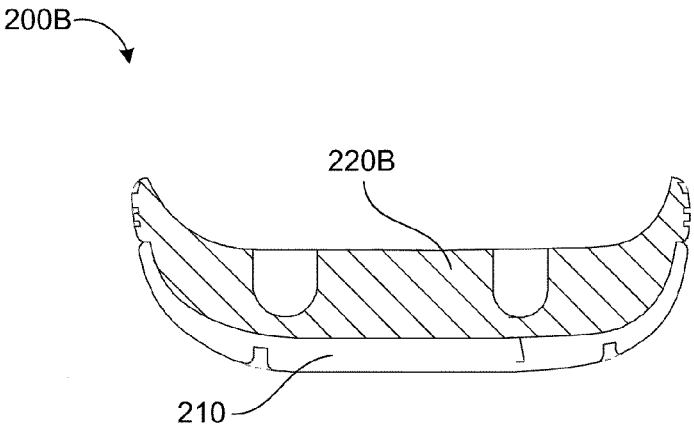
FIG. 4J is a section view of the sole assembly of FIG. 4G along line 4J-4J.
Figure 5A:
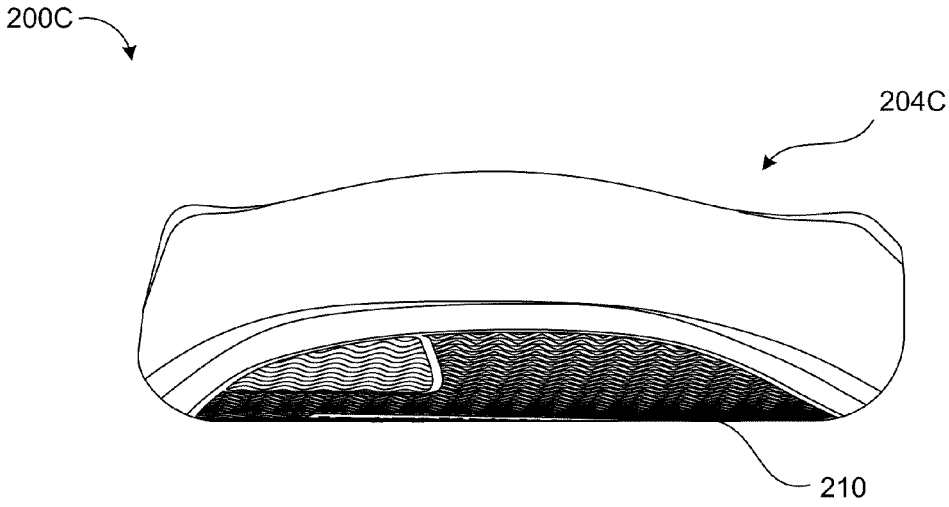
FIG. 5A is a front view of a sole assembly.
Figure 5B:
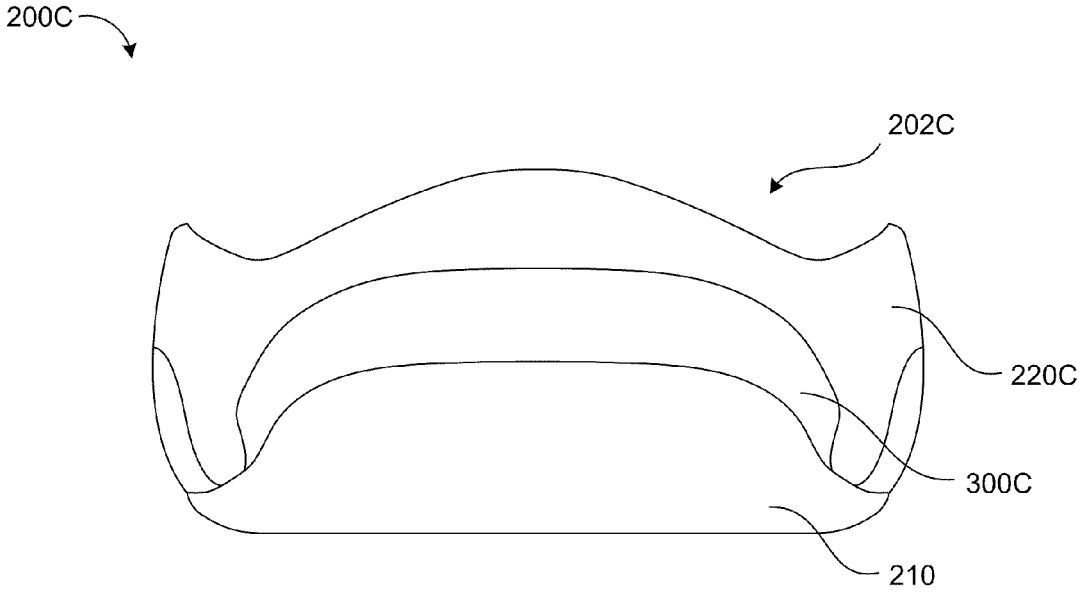
FIG. 5B is a rear view of a sole assembly.
Figure 5C:
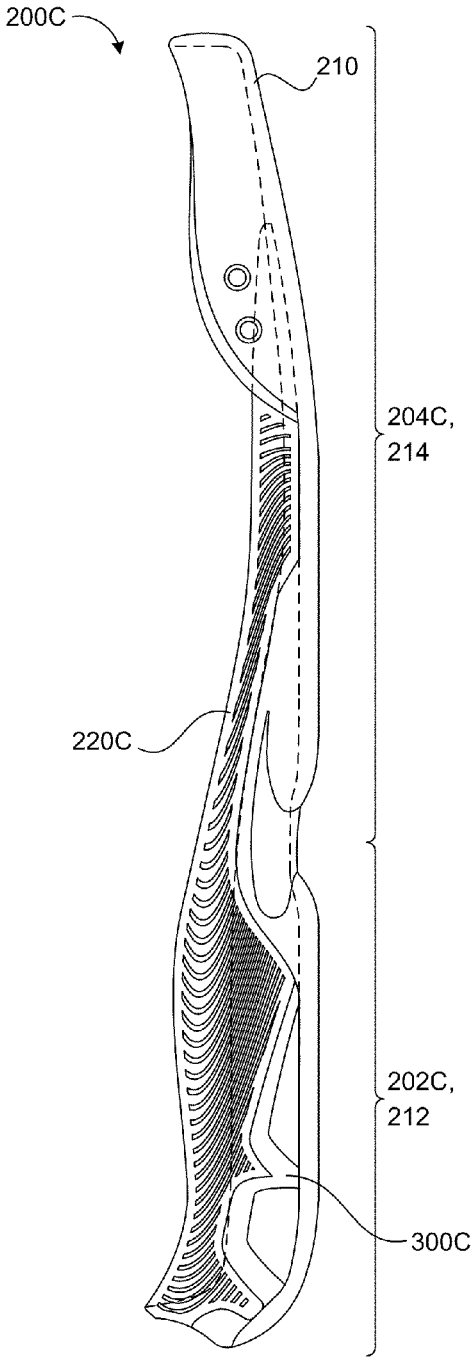
FIG. 5C is a right side view of a sole assembly.
Figure 5D:
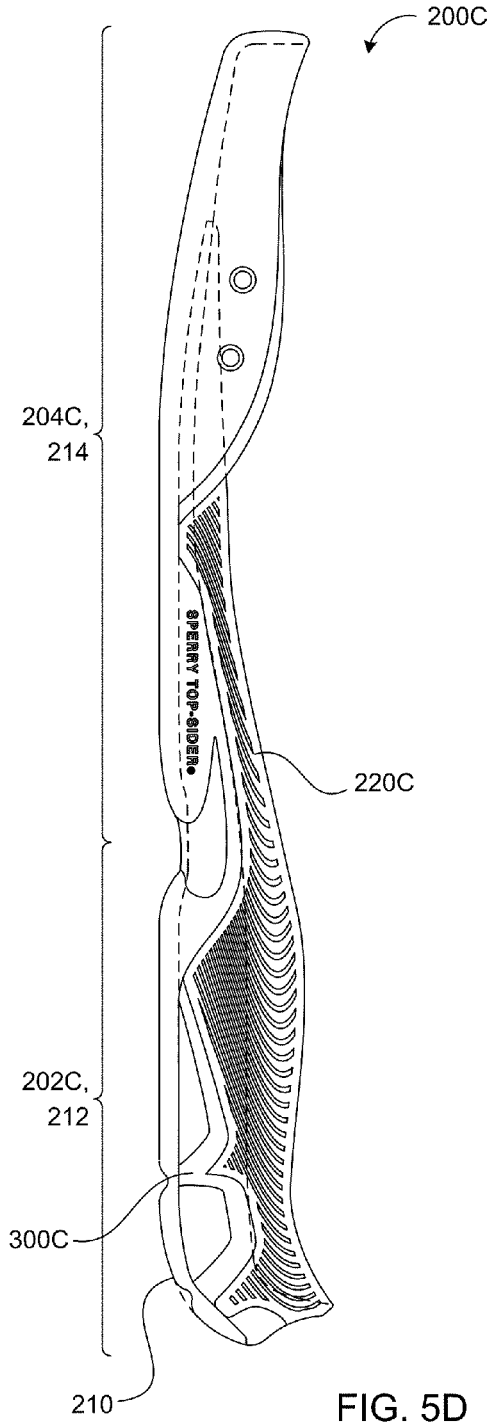
FIG. 5D is a left side view of a sole assembly.
Figure 5E:
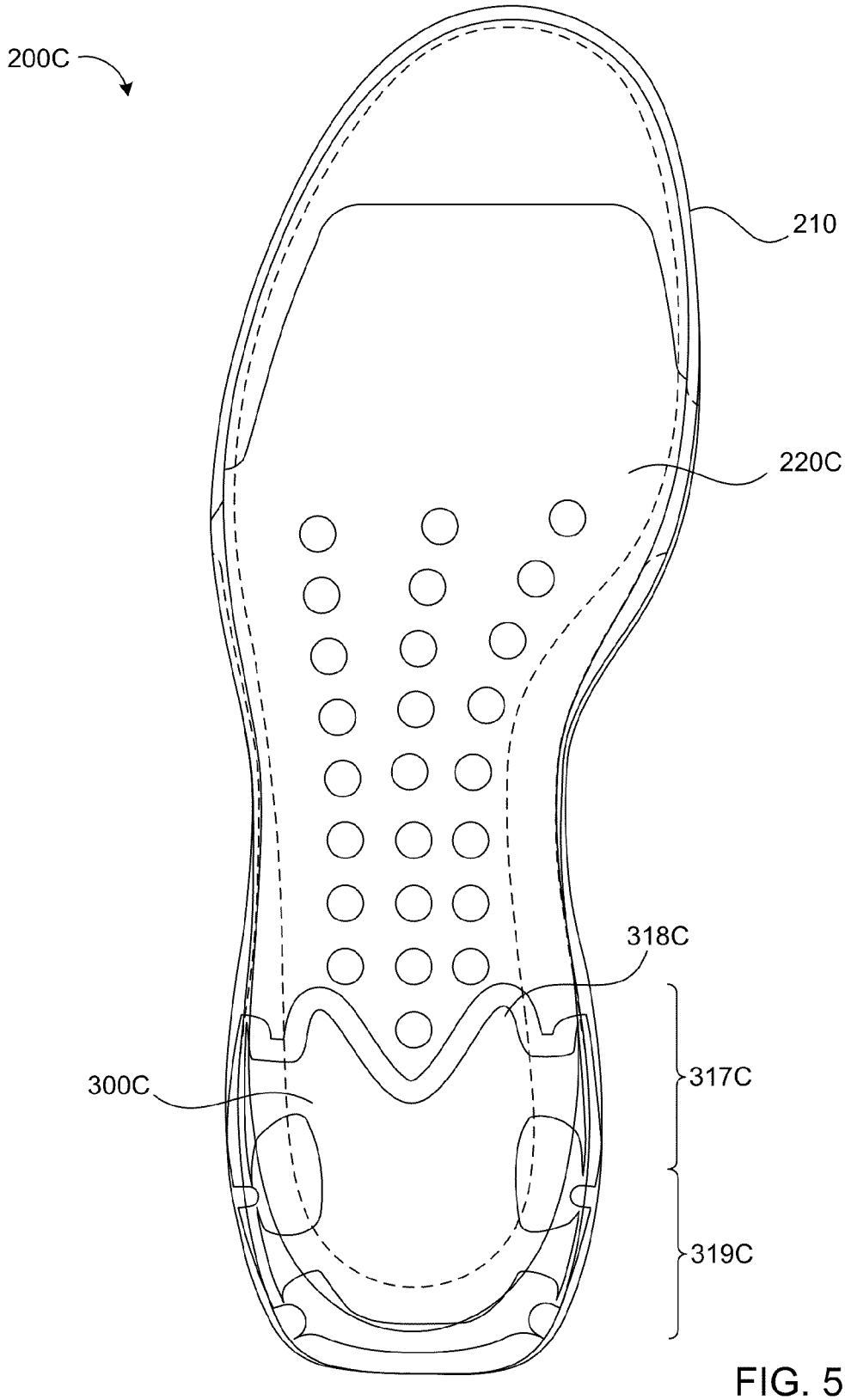
FIG. 5E is a top view of a sole assembly.
Figure 5F:
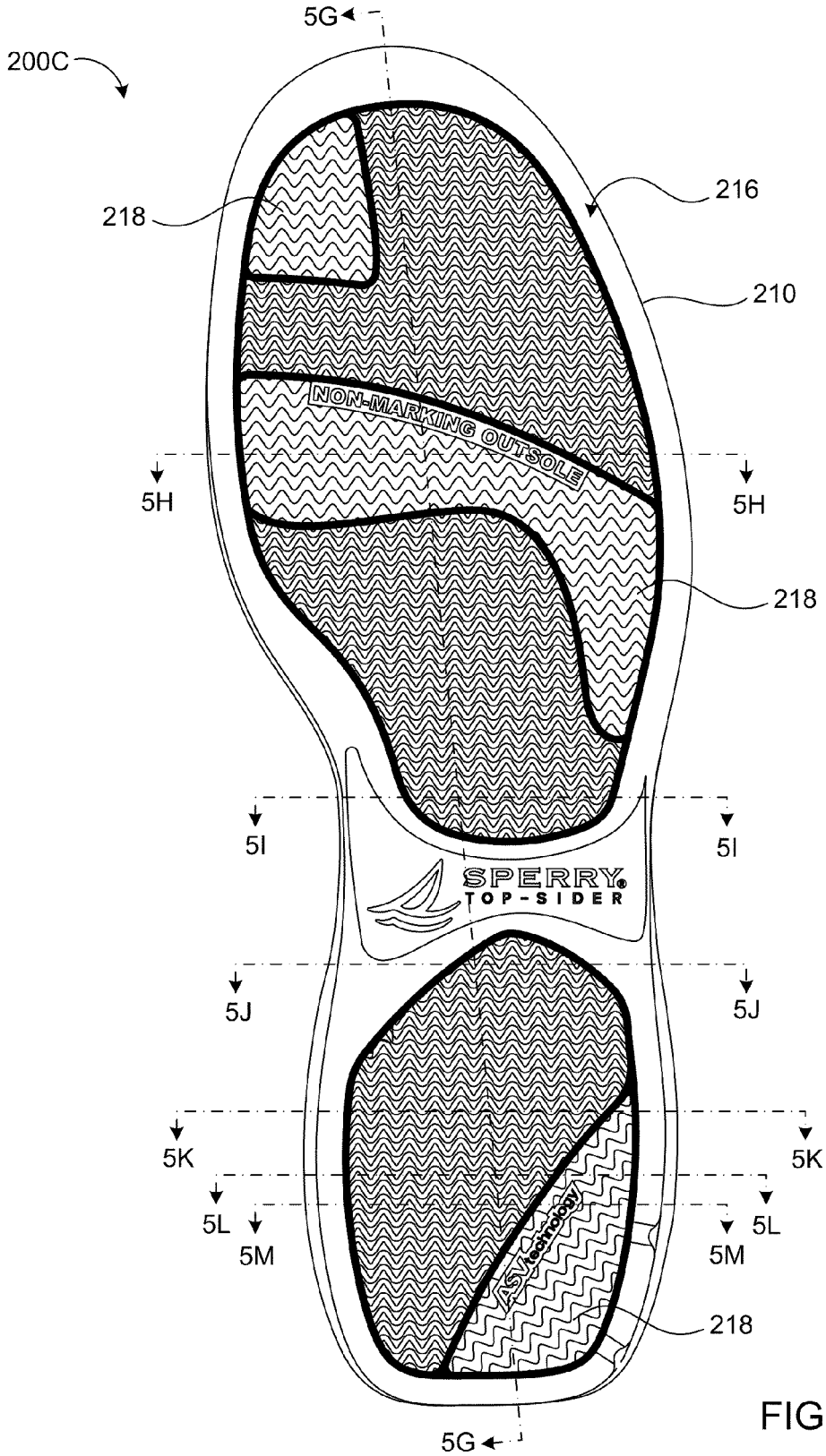
FIG. 5F is a bottom view of a sole assembly.
Figure 5G:
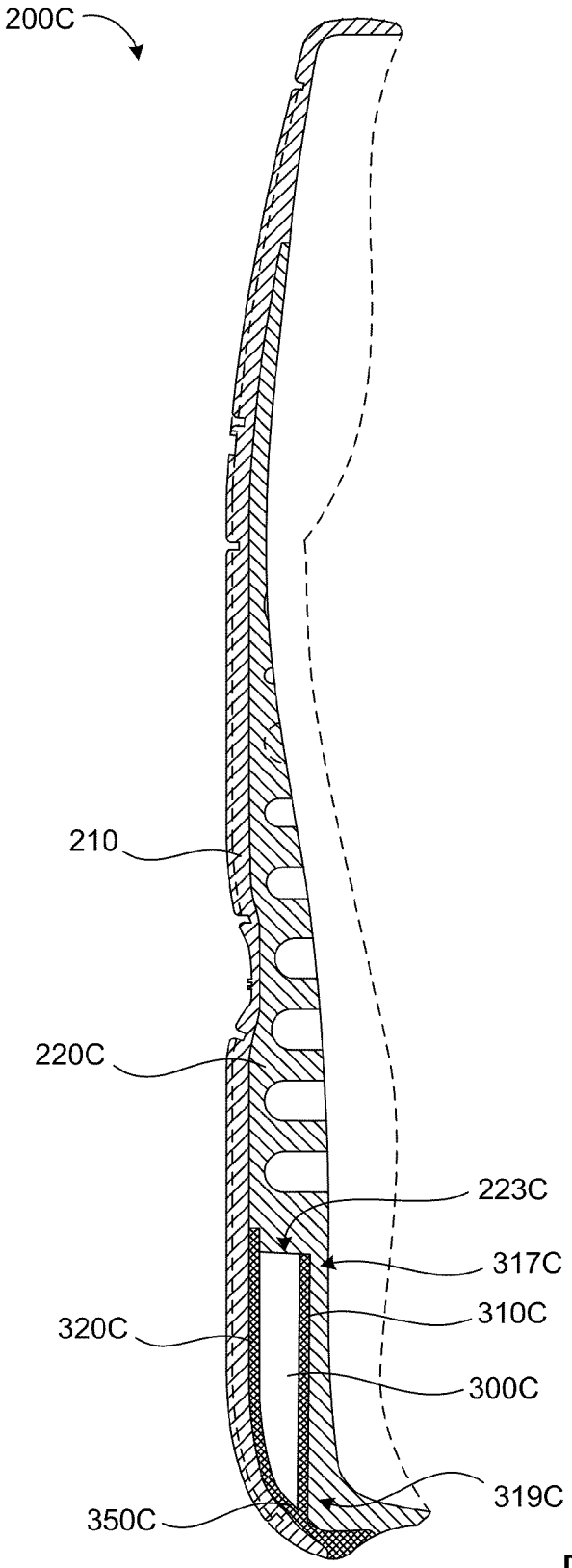
FIG. 5G is a section view of the sole assembly of FIG. 5F along line 5G-5G.
Figure 5H:
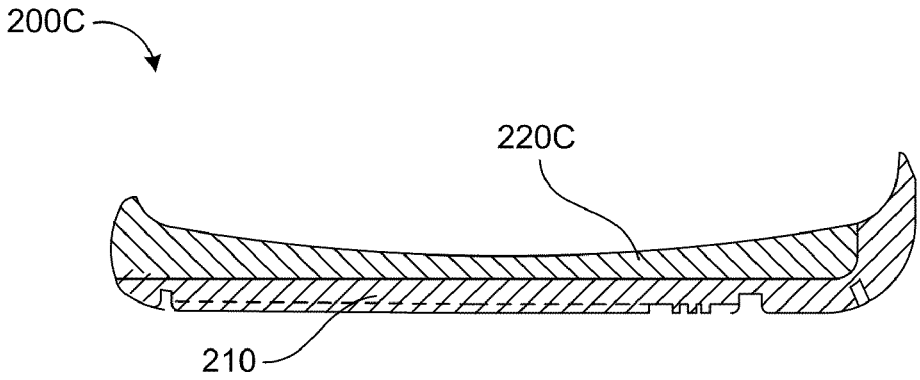
FIG. 5H is a section view of the sole assembly of FIG. 5F along line 5H-5H.
Figure 5I:
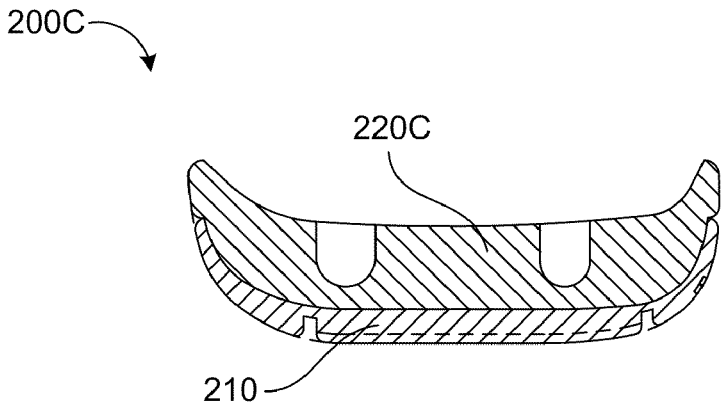
FIG. 5I is a section view of the sole assembly of FIG. 5F along line 5I-5I.
Figure 5J:
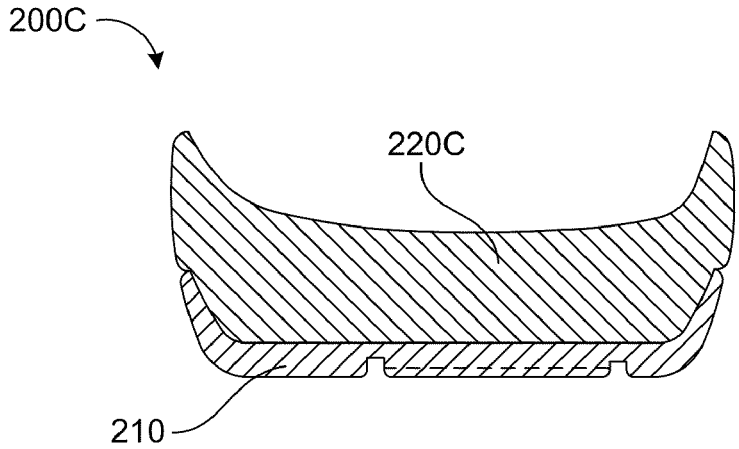
FIG. 5J is a section view of the sole assembly of FIG. 5F along line 5J-5J.

In some implementations, the outsole 210 and the midsole 220 are configured to provide further dampening and shock absorption of the sole assembly, as by material selection. The outsole 210, as shown in the examples of FIGS. 3E, 4G and 5F, has a bottom surface 216 that can have siped or molded-siped regions 218. The siped or molded-siped bottom surface 216 provides traction on wet surfaces (e.g. boat deck). The outsole 210 can be formed of thermoset elastomeric material, e.g., natural rubber. The deck assembly 300 can be made of a thermoplastic, e.g., polyolefin material, thermoplastic urethane (TPU), or nylon. The midsole 220 can be made of a polyurethane, ethylene vinyl acetate (EVA). Preferably, the outsole 210 is formed of a rubber compound including isobutylene rubber, butadiene rubber, styrene butadiene rubber and/or natural rubber, which exhibits a balance of traction and shock absorbing characteristics. The outsole 210 has a durometer of between about 40 Shore A and about 70 Shore A (preferably 50 Shore A).

Figure 3F:
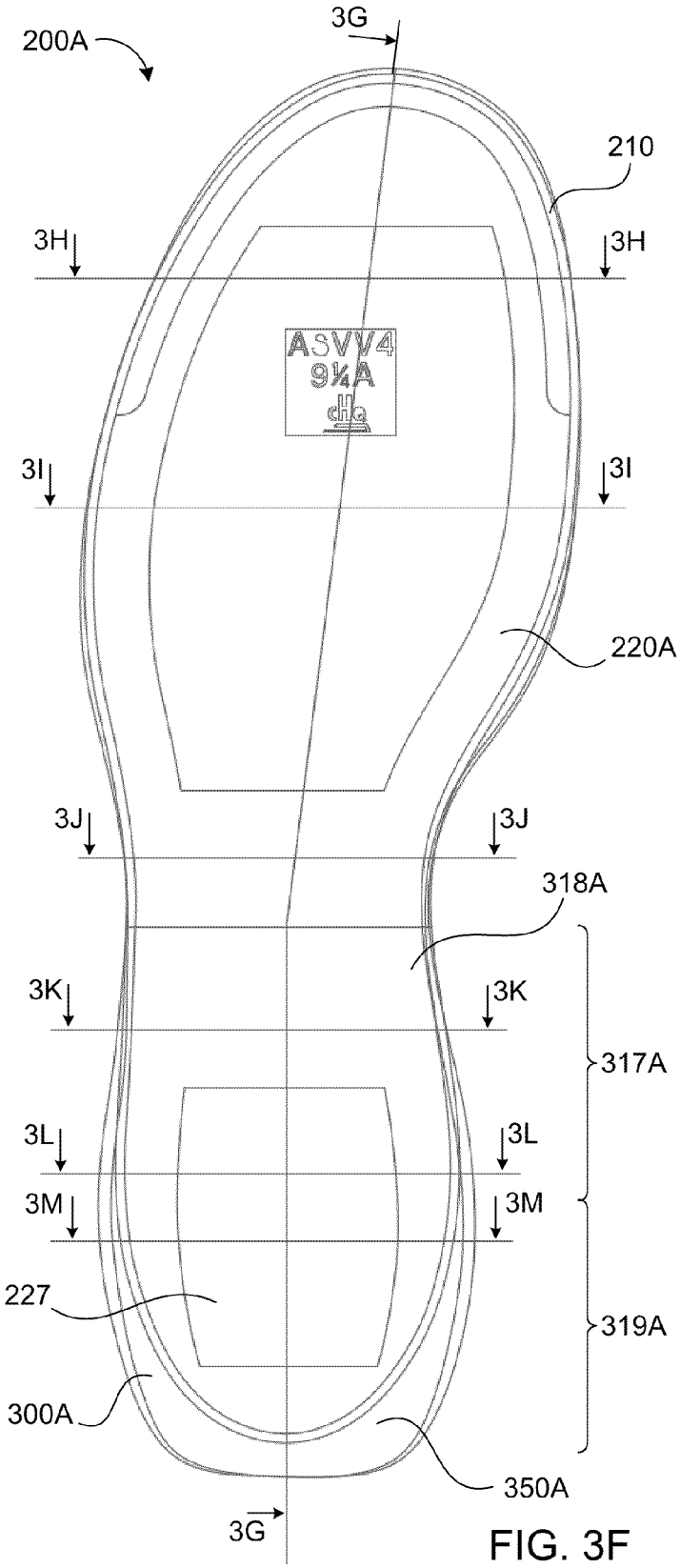
FIG. 3F is a top view of a sole assembly.
Figure 3G:
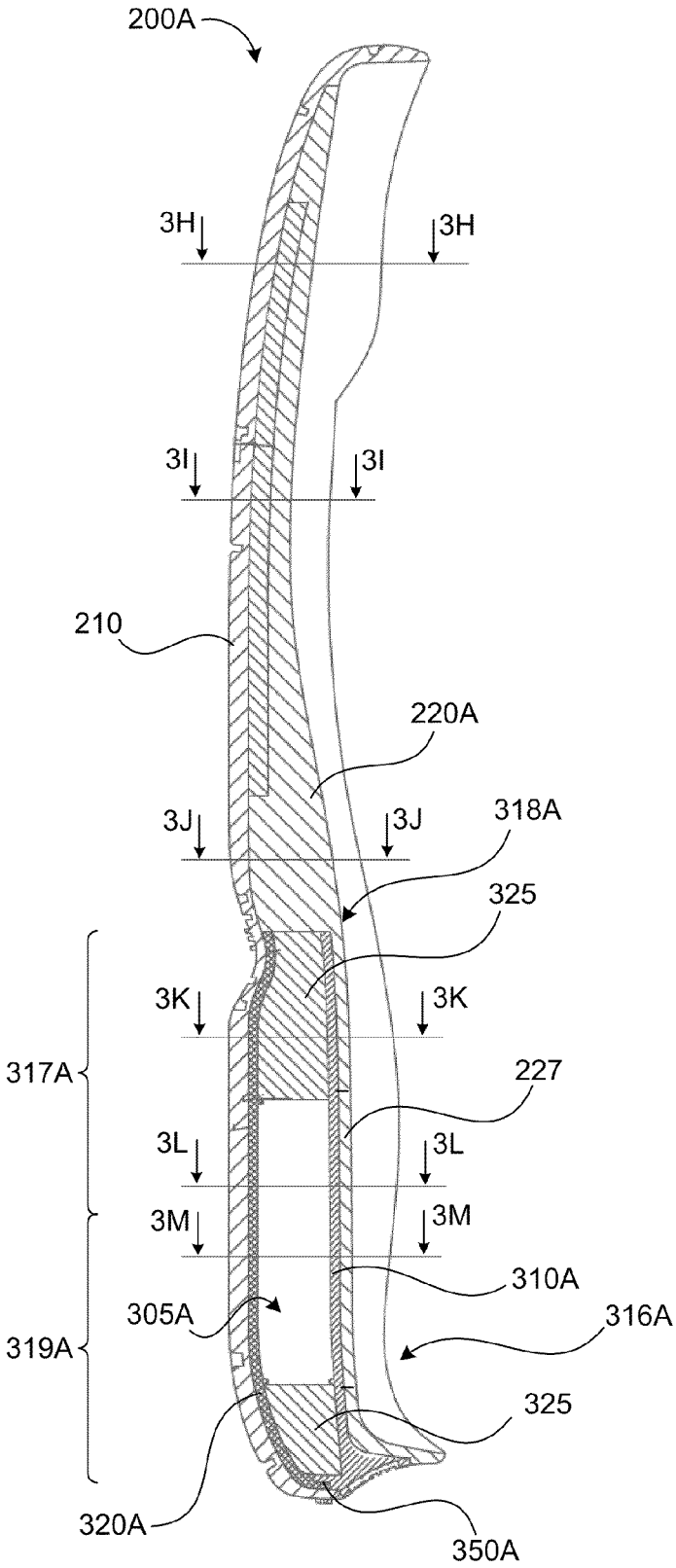
FIG. 3G is a section view of the sole assembly of FIG. 3E along line 3G-3G.

The midsole 220 is preferably constructed of a shock absorbing material. For example, the midsole 220 can be formed of a shock absorbing polyurethane. The midsole 220 has a durometer of between about 40 Asker C and about 70 Asker C (preferably 50 Asker C). In some implementations, the midsole 220 includes a heel insert 227 disposed to receive a user's heel (FIGS. 3F-3G). The heel insert 227 may have a durometer of between about 30 Asker C and about 40 Asker C (preferably about 45 Asker C).

In the example shown in FIGS. 3A-3D, the sole assembly 200A includes a midsole 220A disposed on the outsole 210 in at least the forefoot portion 204A of the sole assembly 200A and a deck assembly 300A disposed on the outsole 210 in the heel portion 202A of the sole assembly 200A, substantially in between the outsole 210 and the midsole 220A. The deck assembly 300A includes upper and lower portions 310A, 320A. In the example shown in FIGS. 4A-4D, the sole assembly 200B includes a midsole 220B disposed on the outsole 210 in at least the heel portion 202B of the sole assembly 200B and a deck assembly 300B having upper and lower portions 310B, 320B disposed on the midsole 220B in the heel portion 202B of the sole assembly 200B. In the example shown in FIGS. 5A-5D, the sole assembly 200C includes a midsole 220C disposed on the outsole 210 in at least the forefoot portion 204C of the sole assembly 200C and a deck assembly 300C having upper and lower portions 310C, 320C disposed on the outsole 210 in the heel portion 202C of the sole assembly 200C, substantially in between the outsole 210 and the midsole 220C.

FIGS. 2A-3M show an implementation of the sole assembly 200, 200A with the deck assembly 300A disposed on the outsole 210 in the heel portion 202A of the sole assembly 200A, substantially in between the outsole 210 and the midsole 220A. The lower deck portion 320A rests on the outsole 210, and the midsole 220A defines a receiver or contour 223A configured to receive the deck assembly 300A. In the example shown in FIGS. 3F and 3G, the toeward portion 317A of the upper deck portion 310A is supported along a forward edge region 318A. The heelward portion 319A of the upper deck portion 310A is shown supported by a rear support 350A joined to the lower deck portion 320A. In some examples, the lower deck portion 320A gradually transitions into the rear support 350A, forming a gentle curve. In some examples, the upper and lower deck portions 310A, 320A together form the rear support 350A (e.g., upper and lower portions of the rear support 350A, respectively). In the example shown, the upper deck portion 310A defines a heel cup portion 316A configured to receive the heel of a foot. The sides of the heel cup portion 316A provide stability for the received foot.

Figure 3H:
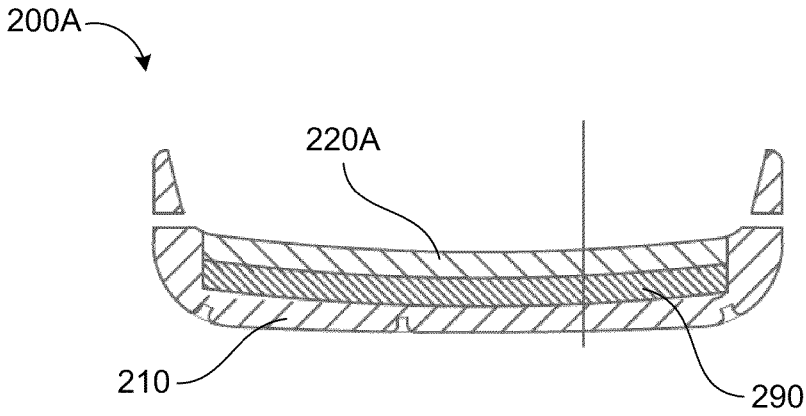
FIG. 3H is a section view of the sole assembly of FIG. 3E along line 3H-3H.
Figure 3I:
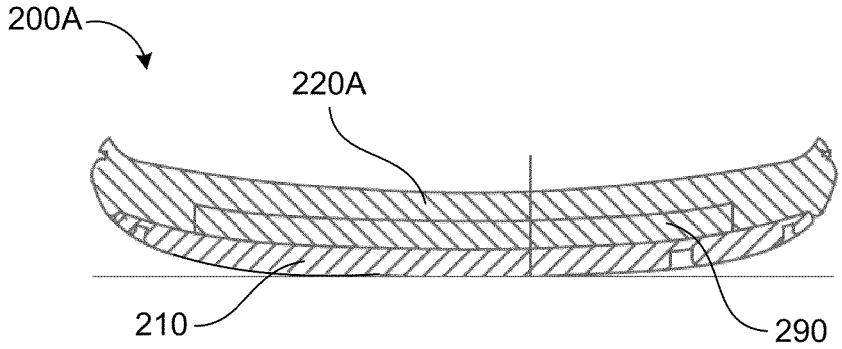
FIG. 3I is a section view of the sole assembly of FIG. 3E along line 3I-3I.
Figure 3J:
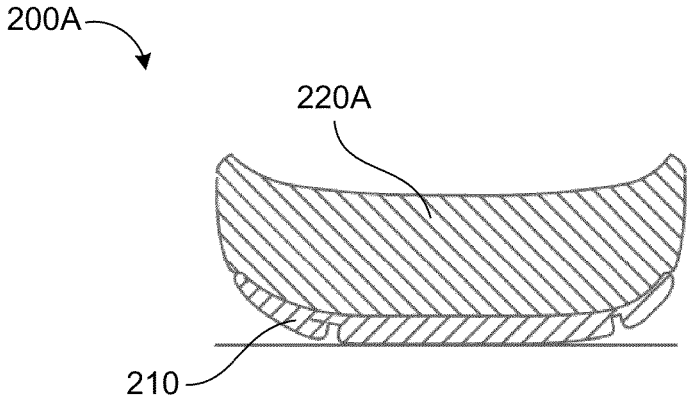
FIG. 3J is a section view of the sole assembly of FIG. 3E along line 3J-3J.

In the examples shown in FIG. 3H-3I, the forefoot portion 204A of the sole assembly 200A includes a forefoot cushion layer 290 disposed between the outsole 210 and the midsole 220A (preferably in a recess defined by the midsole 220A). The forefoot cushion layer 290 provides additional shock absorption and cushioning for a users foot. The forefoot cushion layer 290 (e.g. polyurethane foam) may be made of polyurethane and have a durometer of between 40 Asker C and 70 Asker C, preferably 50 Asker C.

Figure 3K:
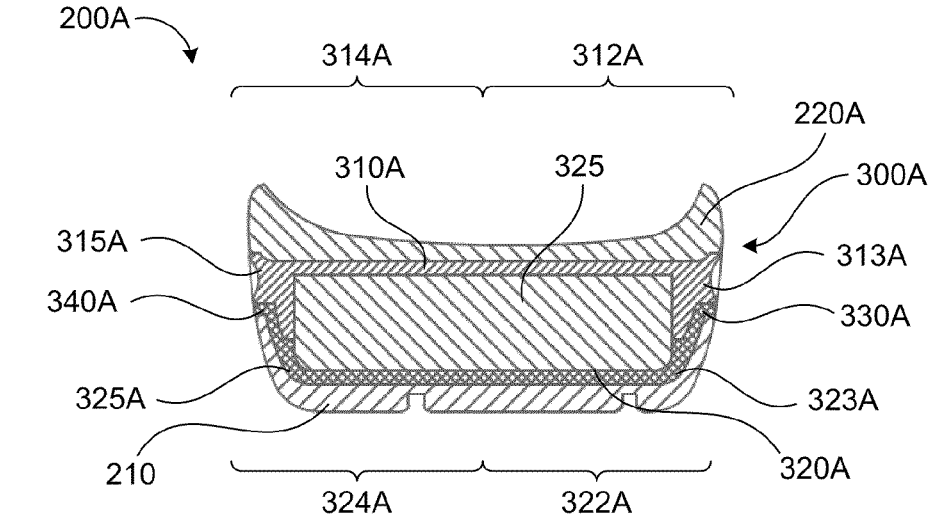
FIG. 3K is a section view of the sole assembly of FIG. 3E along line 3K-3K.
Figure 3L:
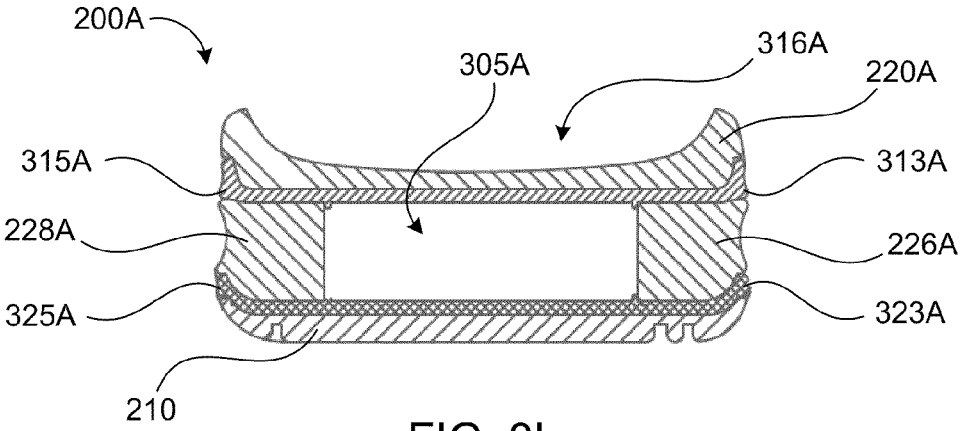
FIG. 3L is a section view of the sole assembly of FIG. 3E along line 3L-3L.
Figure 3M:
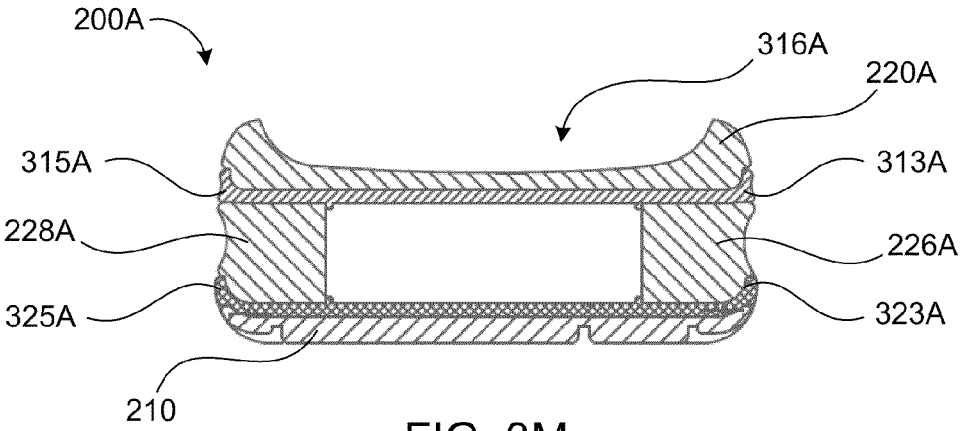
FIG. 3M is a section view of the sole assembly of FIG. 3E along line 3M-3M.

Referring to FIGS. 3K-3M, the upper deck portion 310A has right and left portions 312A, 314A, which have corresponding right and left lateral edges 313A, 315A. The lower deck portion 320A has right and left portions 322A, 324A, which have corresponding right and left lateral edges 323A, 325A. The deck assembly 300A includes right and left supports 330A, 340A attached to or disposed between the respective right and left portions 312A, 314A of the upper deck portion 310A and to the respective right and left portions 322A, 324A of the lower deck portion 320A in the toeward portion 317A of the upper deck portion 310A and, in some examples, at or near the forward edge region 318A. In some implementations, the right and left supports 330A, 340A are attached to the upper and lower deck portions 310A, 320A substantially near the respective right and left lateral edges 313A, 315A of the upper deck portion 310A and the respective right and left lateral edges 323A, 325A of the lower deck portion 320A. The right and left supports 330A, 340A may be made of the same material as the upper and lower deck portions 310A, 320A; however, in some preferred implementations, the right and left supports 330A, 340A are made of a more compliant material than the upper and lower deck portions 310A, 320A. In some examples, the right and left supports 330A, 340A are integral with and extend gradually from the upper and lower deck portions 310A, 320A. In other examples, the upper and lower deck portions 310A, 320A are attached or disposed together to form a shell, which defines an inner cavity 305. The upper and lower deck portions 310A, 320A meet along the right and left supports 330A, 340A and rear support 350A, which each have upper and lower portions disposed on the respective upper and lower deck portions 310A, 320A.

The sole assembly 200A, in some implementations, includes a second midsole 225A (shown in FIGS. 2A-2D and 3G) configured to support the toeward portion 317A of the upper deck portion 310A (e.g., along a forward edge region 318A) and at least part of the right and left portions 312A, 314A of the upper deck portion 310A substantially near the respective right and left lateral edges 313A, 315A of the upper deck portion 310A. The second midsole 225A may comprise ethylene-vinyl acetate (EVA) having a durometer of between about 45 Asker C and about 65 Asker C. In the examples shown in FIGS. 3L-3M, the second midsole 225A defines or includes right and left side supports 226A, 228*a*, which at least partially support the respective right and left lateral edges 313A, 315A of the upper deck portion 310A. The second midsole 225A may also provide support between the upper and lower deck portions in the heelward portion 319A of the upper deck portion 310A, rearward of the cavity 305A defined between the upper and lower deck portions 310A, 320A. In some examples, the second midsole 225A defines portions (e.g., walls) of the cavity 305A along with the upper and lower deck portions 310A, 320A. The cavity 305A prevents or substantially inhibits direct transmission or propagation of shock or impact forces incurred by the heel portion 212 of the sole 210. The second midsole 225A or at least the right and left side supports 226A, 228A have the same, if not greater, anti-shock and vibration reduction characteristic as the first midsole 220A, thereby reducing the vibrations and forces experienced by a user in the heel portion 202A of the sole assembly 200A.

Figure 2A:
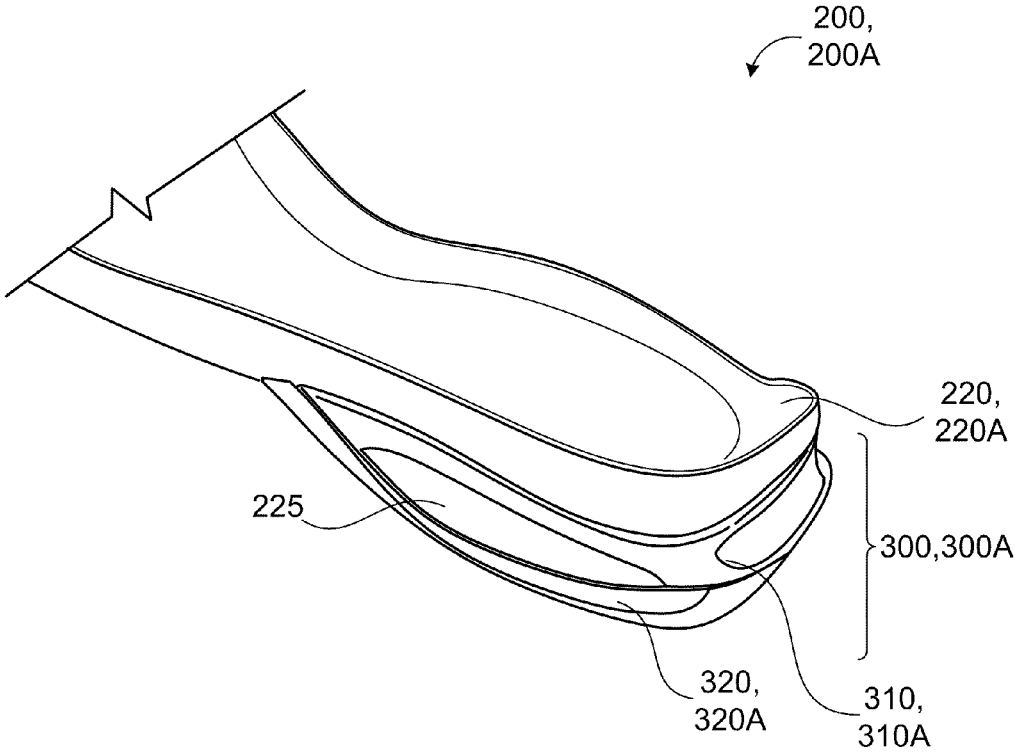
FIG. 2A is a perspective view of a sole assembly.
Figure 2B:
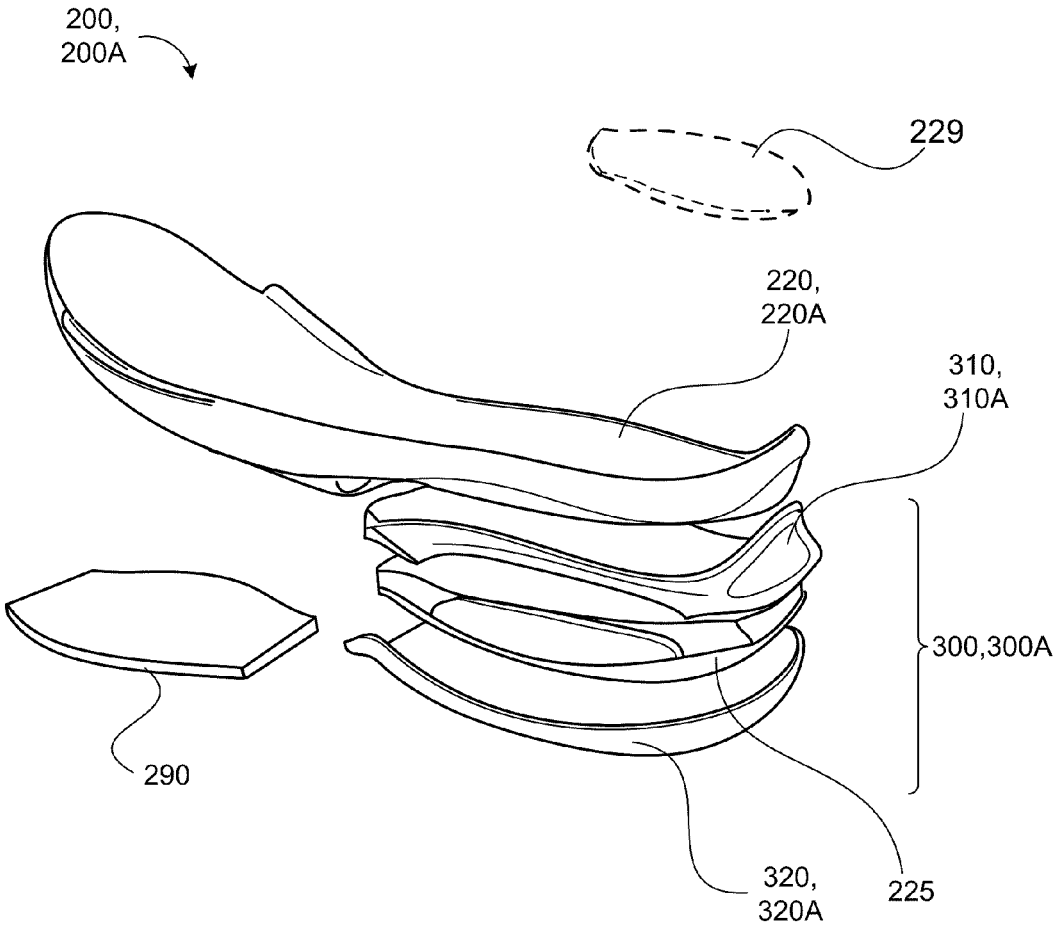
FIG. 2B is an exploded view of the sole assembly of FIG. 2A.
Figure 2C:
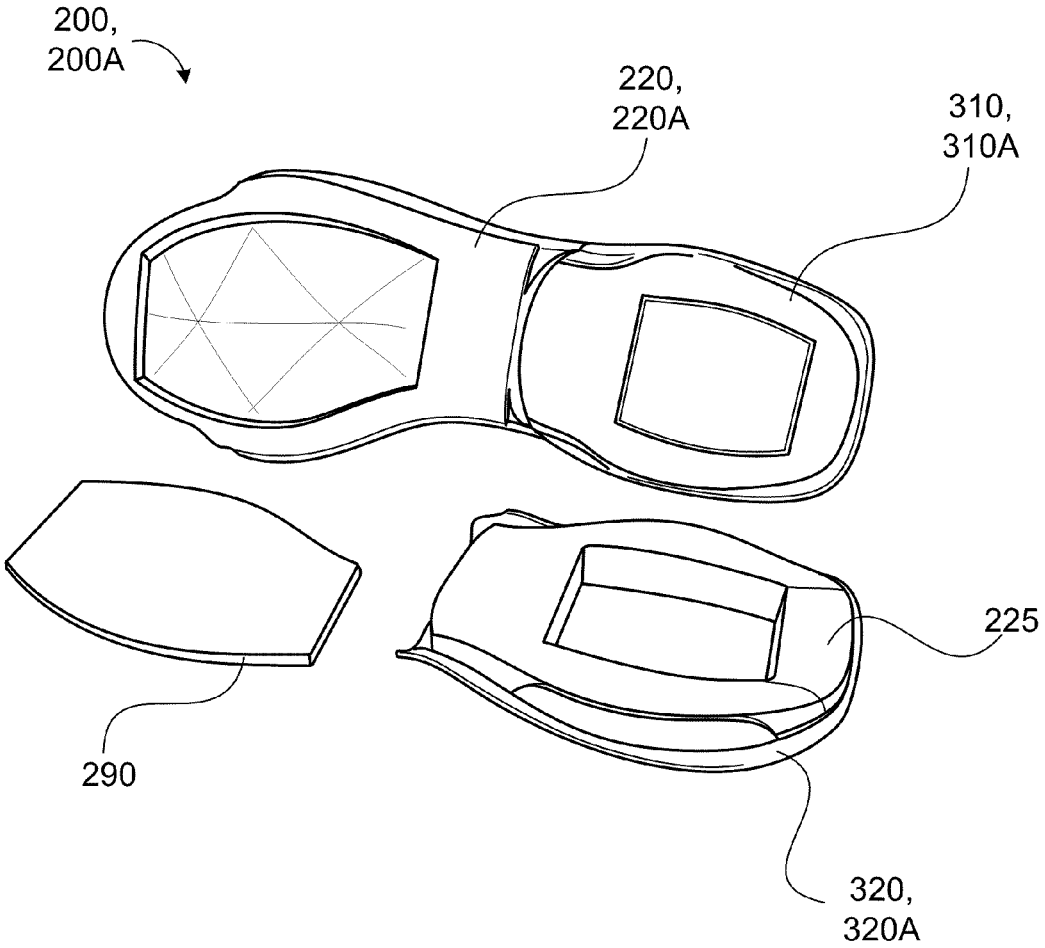
FIG. 2C is a partial exploded view of the sole assembly of FIG. 2A.
Figure 2D:
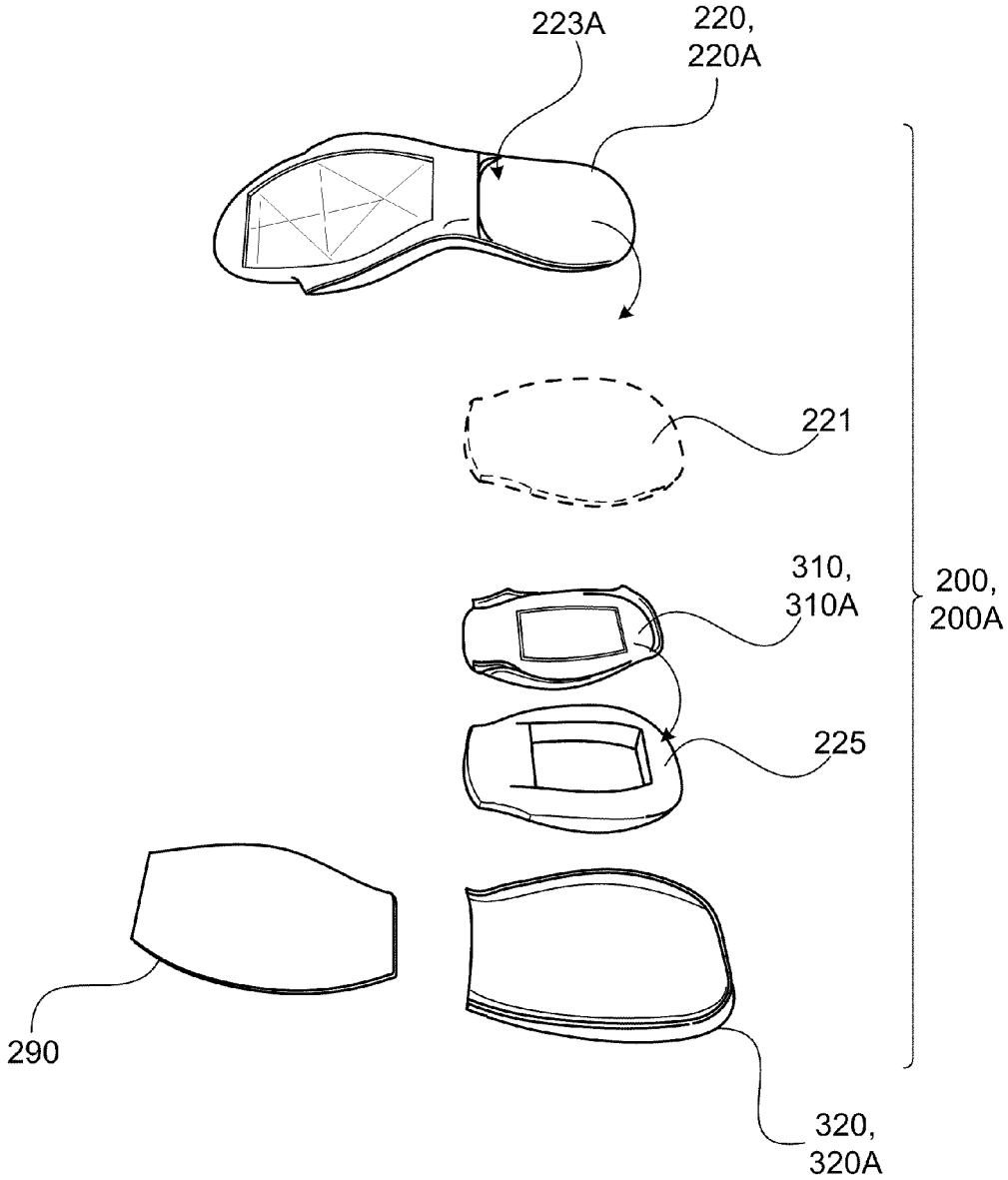
FIG. 2D is an exploded view of the sole assembly of FIG. 2A.

In the implementations shown in FIGS. 2B and 2D, a first foam insert 221 is disposed on the upper deck portion 310, 310A, situating the first foam insert 221 between the deck assembly 300, 300A and the first midsole 220, 220A in the heel portion 202 of the sole assembly 200. The first foam insert 221 may comprise ethylene-vinyl acetate foam, a polyurethane foam, or any other suitable foam. The first foam insert 221 has a durometer of between about 30 Asker C and about 60 Asker C (preferably 43+/−3 Asker C) and a thickness of between about 2 mm and about 10 mm (preferably 4 mm). A second foam insert 229 may be disposed on the first midsole 220, 220A in the heel portion 202 of the sole assembly 200 below a footbed of the shoe 100. The second foam insert 229 may comprise ethylene-vinyl acetate foam, a polyurethane foam, or any other suitable foam. The second foam insert 229 has a durometer of between about 20 Asker C and about 60 Asker C (preferably 33+/−3 Asker C) and a thickness of between about 2 mm and about 10 mm (preferably 4 mm).

Figure 4A:
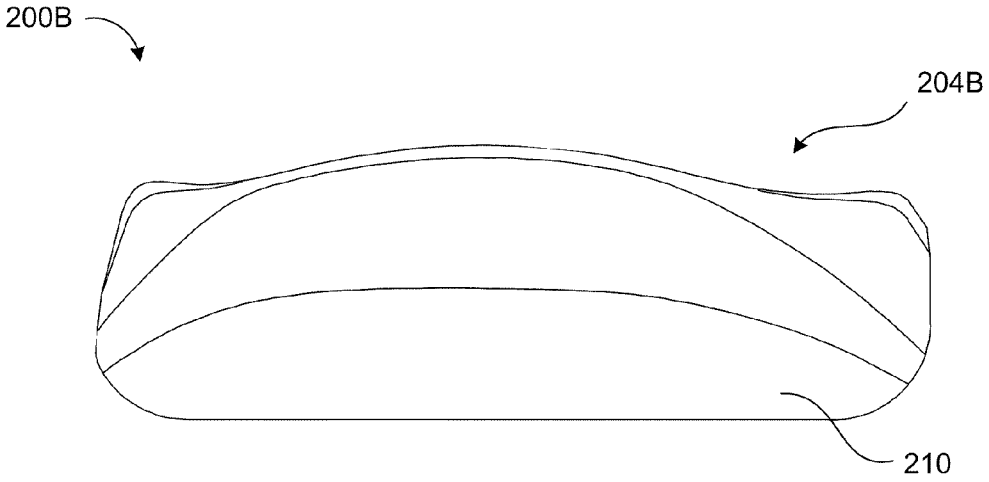
FIG. 4A is a front view of a sole assembly.
Figure 4B:
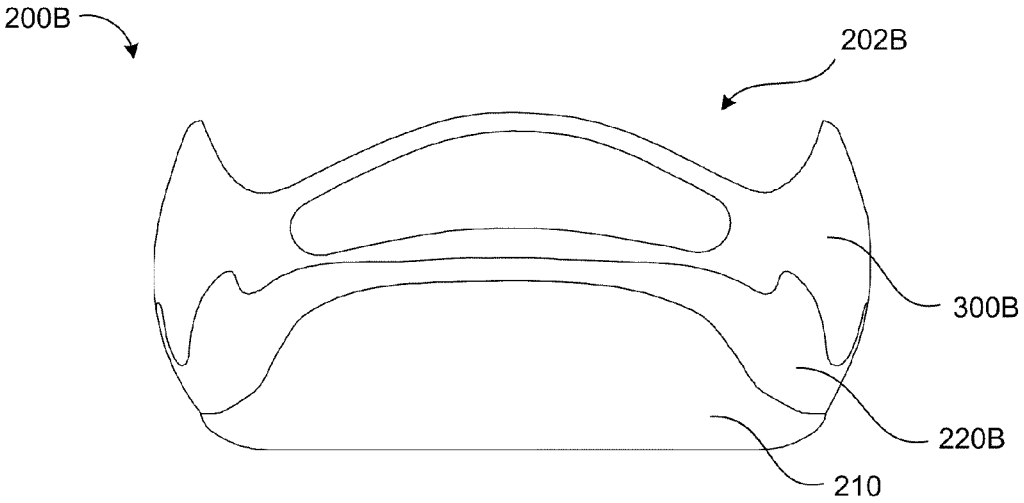
FIG. 4B is a rear view of a sole assembly.
Figure 4C:
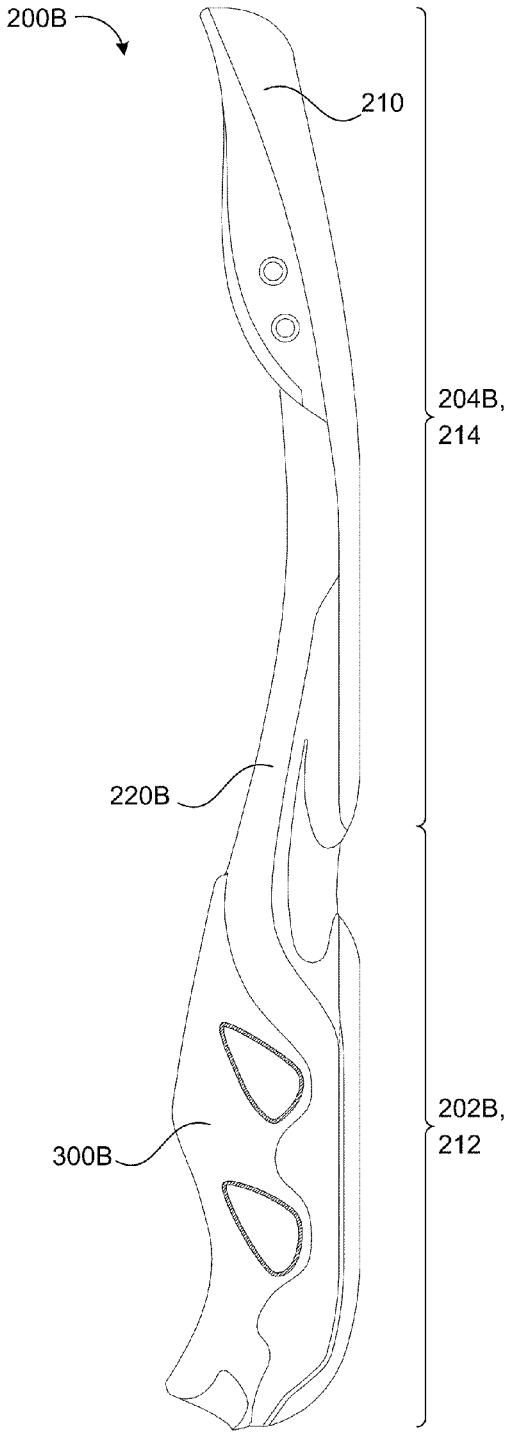
FIG. 4C is a right side view of a sole assembly.
Figure 4D:
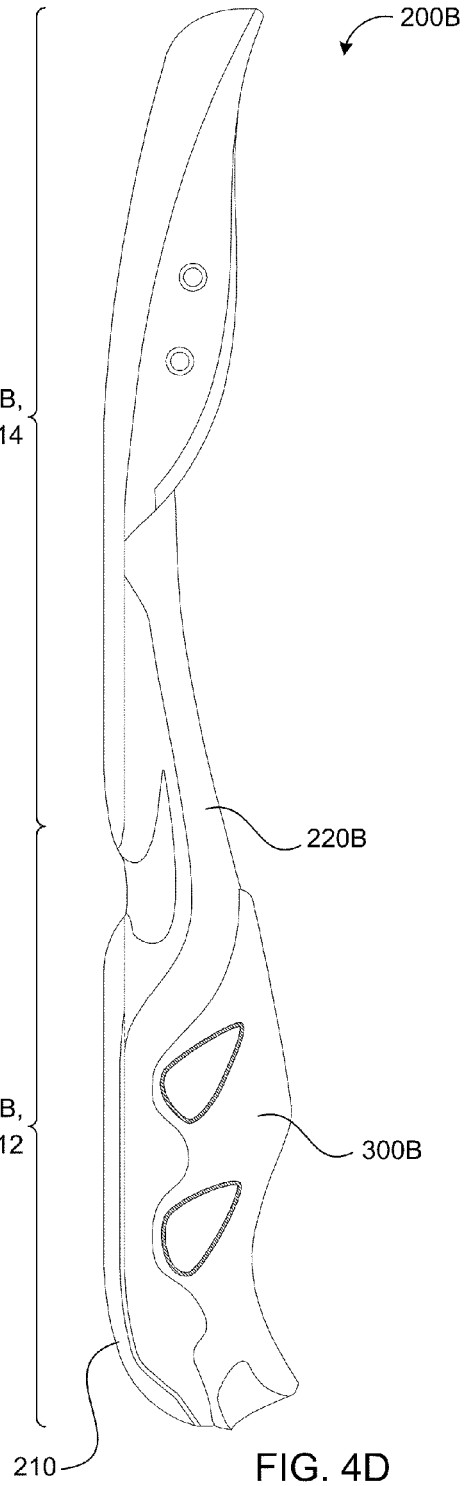
FIG. 4D is a left side view of a sole assembly.
Figure 4E:
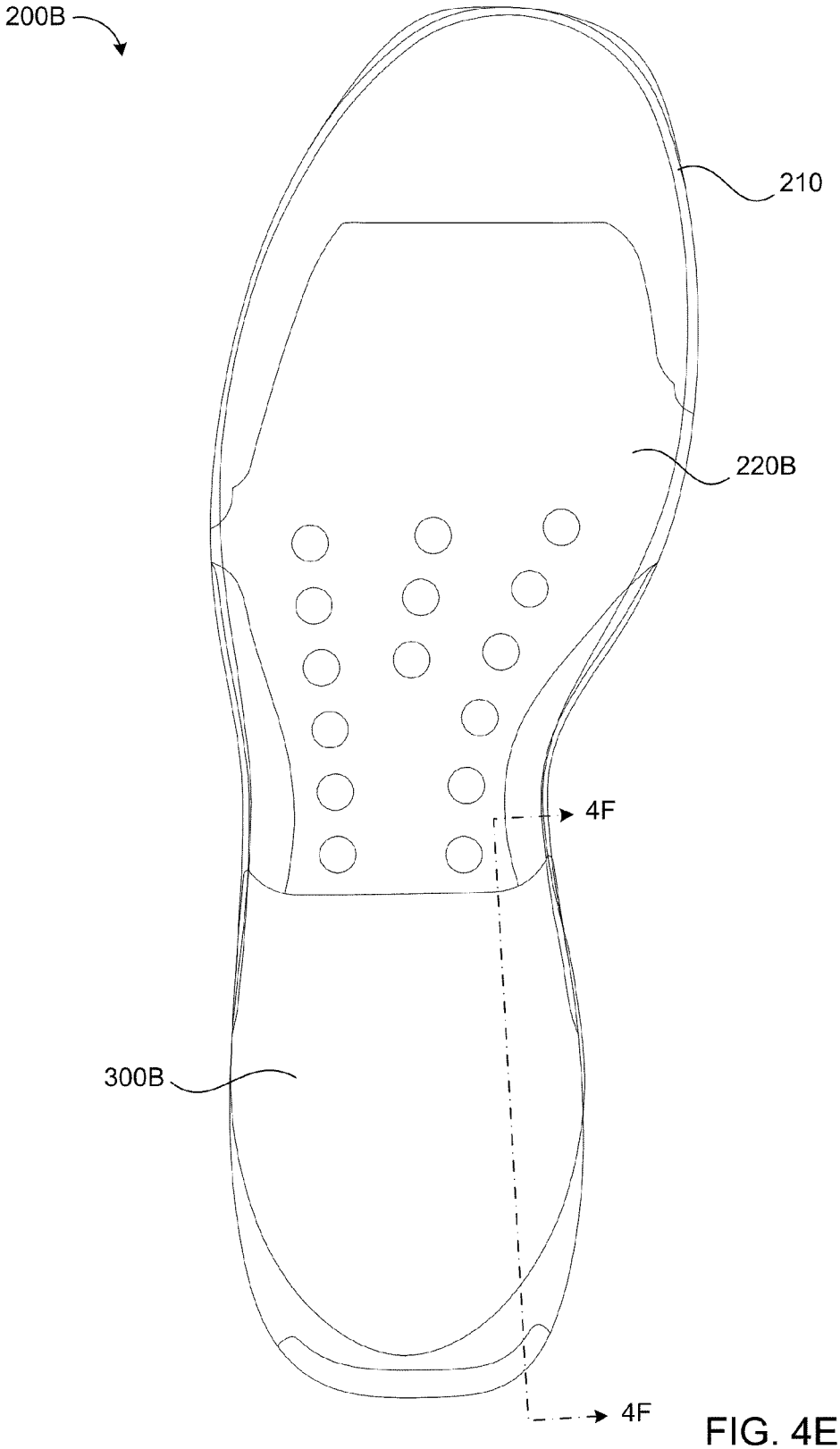
FIG. 4E is a top view of a sole assembly.
Figure 4F:
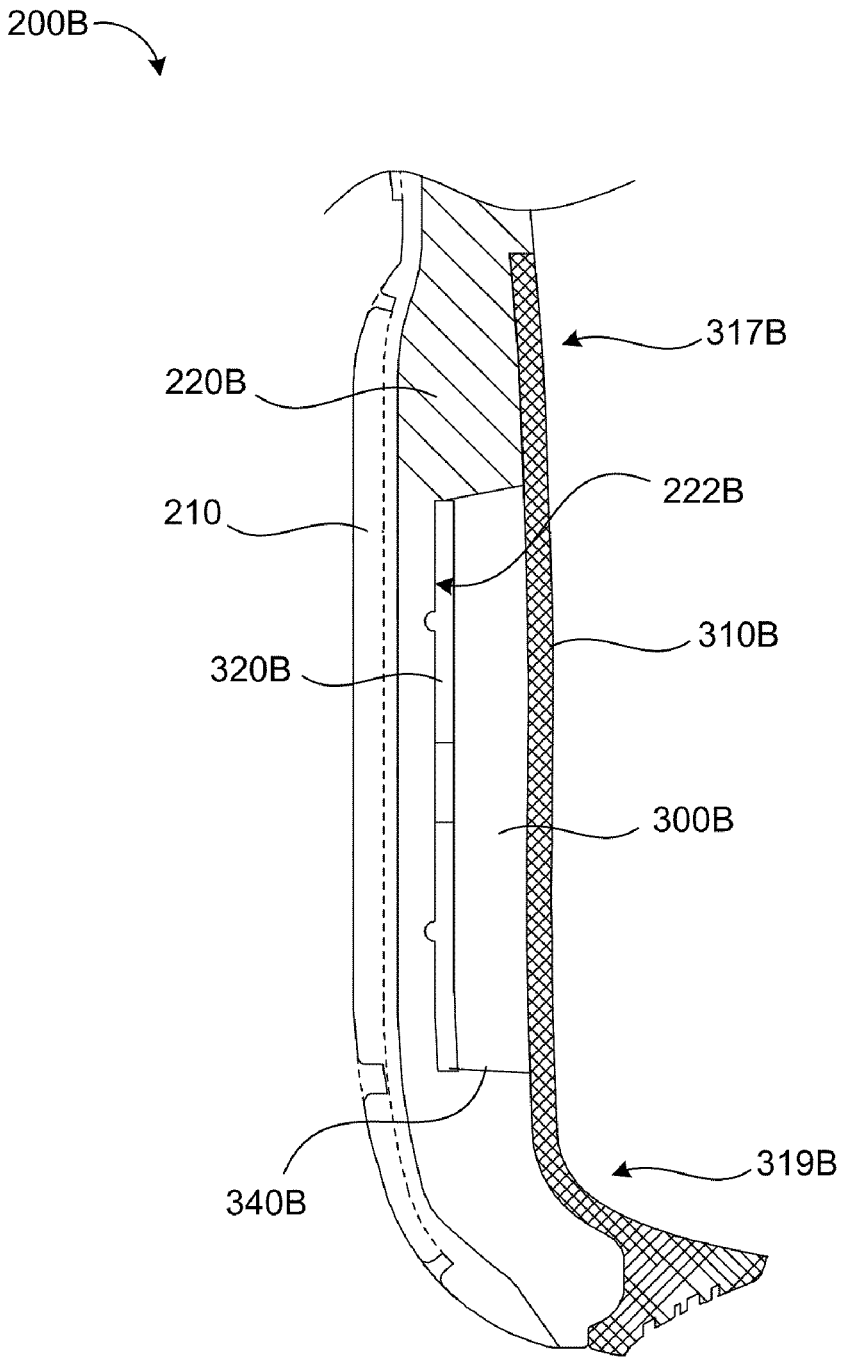
FIG. 4F is a section view of the sole assembly of FIG. 4E along line 4F-4F.
Figure 4K:
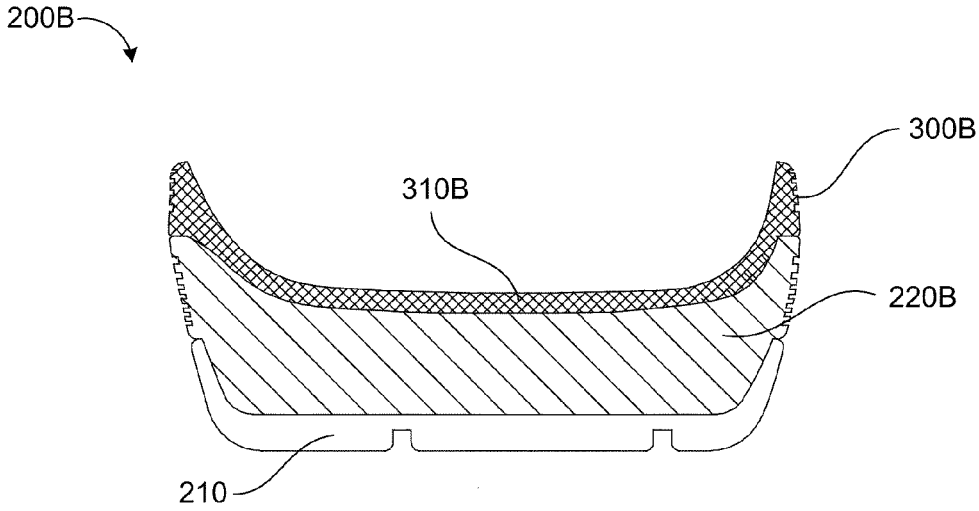
FIG. 4K is a section view of the sole assembly of FIG. 4G along line 4K-4K.
Figure 4L:
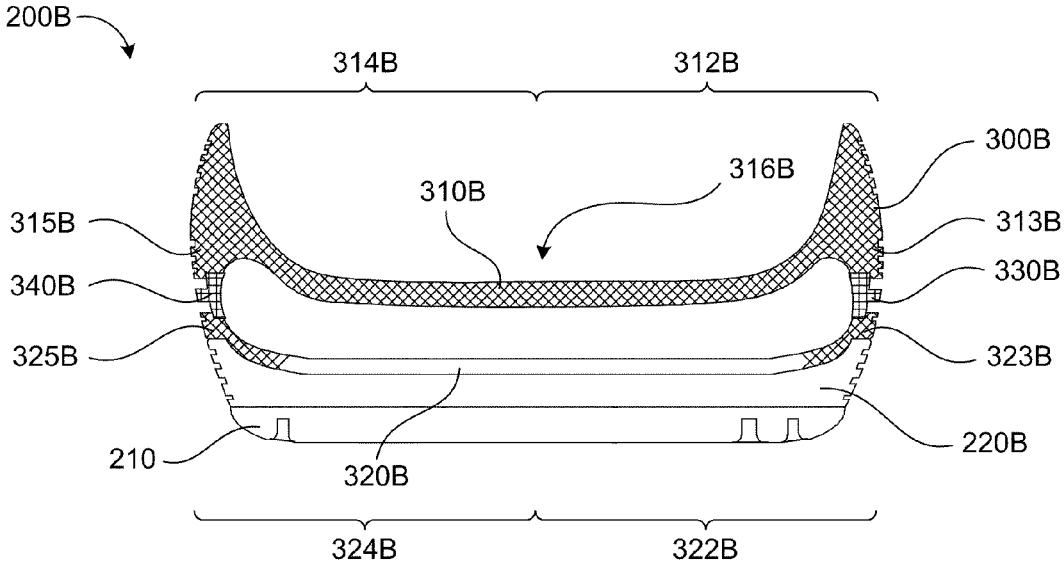
FIG. 4L is a section view of the sole assembly of FIG. 4G along line 4L-4L.
Figure 4M:
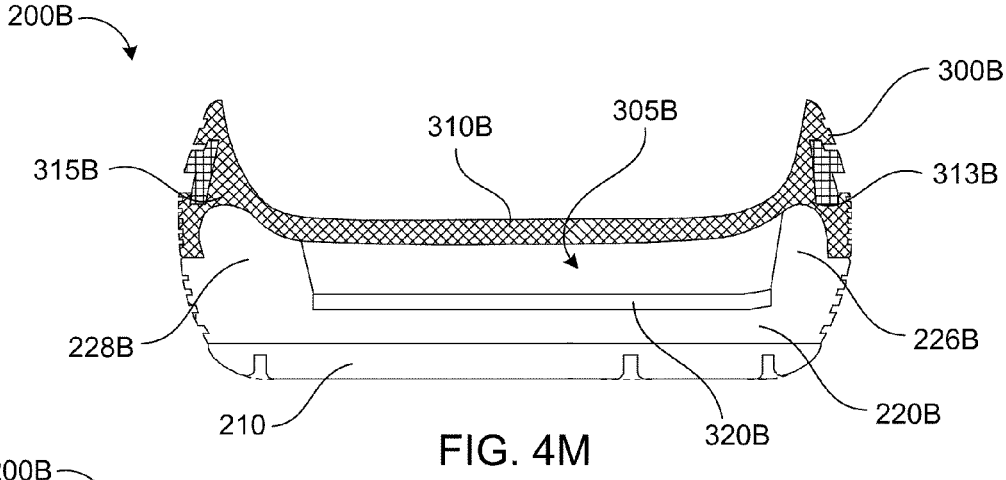
FIG. 4M is a section view of the sole assembly of FIG. 4G along line 4M-4M.
Figure 4N:
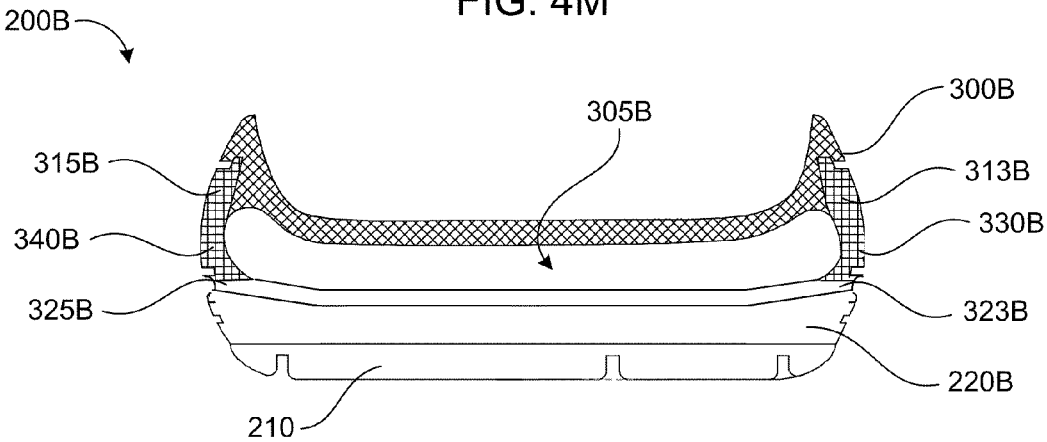
FIG. 4N is a section view of the sole assembly of FIG. 4G along line 4N-4N.

FIGS. 4A-4N show an implementation of the sole assembly 200, 200B with a deck assembly 300B disposed on the midsole 220B in the heel portion 202B of the sole assembly 200B. In some implementations, the deck 300B includes an upper deck portion 310B and a lower deck portion 320B vertically spaced below the upper deck portion 310B. Referring to FIGS. 4F and 4K, the upper deck portion 310B is at least partially supported by the midsole 220B. In the example shown, the lower deck portion 320B is a plate defining a substantially rectangular shape; however, other shapes may be defined as well, such as, but not limited, elliptical, trapezoidal, etc. The midsole 220B defines a depression 222B configured to receive the lower deck portion 320B. In some examples, as shown in FIG. 4F, the midsole 220B at least partially supports toeward and heelward portions 317B, 319B of the upper deck portion 310B. In the example shown, the toeward portion 317B of the upper deck portion 310B is continuously supported by the midsole 220B; however, in other examples not shown, the toeward portion 317B of the upper deck portion 310B is intermittently supported by the midsole 220B (e.g., supporting left and right portions of the toeward portion 317B of the upper deck portion 310B or in spaced intervals).

Referring to FIGS. 4L-4N, the upper deck portion 310B has right and left portions 312B, 314B, which have corresponding right and left lateral edges 313B, 315B. In the example shown, the upper deck portion 310B defines a heel cup portion 316B configured to receive the heel of a foot. The sides of the heel cup portion 316B provide stability for the received foot. The lower deck portion 320B has right and left portions 322B, 324B, which have corresponding right and left lateral edges 323B, 325B. A cavity 305B is defined between the upper and lower deck portions 310B, 320B.

The deck 300B includes right and left supports 330B, 340B attached to the respective right and left portions 312B, 314B of the upper deck portion 310B and to the respective right and left portions 322B, 324B of the lower deck portion 320B. In some implementations, the right and left supports 330B, 340B are attached to the upper and lower deck portions 310B, 320B substantially near the respective right and left lateral edges 313B, 315B of the upper deck portion 310B and the respective right and left lateral edges 323B, 325B of the lower deck portion 320B. The right and left supports 330B, 340B direct translation of any ground contact forces incurred by the heel portion 202B of the sole assembly 200B substantially toward the lateral edges 313B, 315B of the upper deck portion 310B. Forces incurred near the center of the heel portion 212 of the outsole 210 are redirected by the deck assembly 300B laterally outward, thus minimizing any forces experienced by the heel of a user's foot, which is situated above the cavity 305B. The deck assembly 300B substantially eliminates direct force translation vertically upward from a supports surface to the heel of a user's foot.

In some implementations, the midsole 220B is configured to support at least part of the right and left portions 312B, 314B of the upper deck portion 310B substantially near the respective right and left lateral edges 313B, 315B of the upper deck portion 310B. In the example shown in FIG. 4M, the midsole 220B defines or includes right and left side supports 226B, 228B, which at least partially support the respective right and left lateral edges 313B, 315B of the upper deck portion 310B. The right and left side supports 226B, 228B have the same, if not greater, anti-shock and vibration reduction characteristic as the rest of the midsole 220B, thereby reducing the vibrations and forces experienced by a user in the heel portion 202B of the sole assembly 200B.

In the example shown in FIGS. 4L and 4N, the right and left supports 330B, 340B define a curved shape, while in other examples, the right and left supports 330B, 340B define a stepped profile or are straight. The curved supports 330B, 340B provide the advantage of additional flexion for shock absorption and a reduction of force translation. In contrast to straight legs, an alternative implementation, curved or bent supports 330B, 340B (e.g. of a compliant material) tend to flex under an applied force rather than directly translate the applied force therethrough. Similarly, step-profile supports tend to flex under an applied force rather than directly translate the applied force therethrough. The step-profile supports can be at least partially supported by the midsole 220B along a run-portion (e.g., horizontal portion) of the step-profile supports. The size, shape, and material of the supports 330B, 340B can be chosen to provide a desired level of shock and vibration absorption, while also redirecting forces laterally. The curved supports 330B, 340B have a thickness of about 1 mm, a width of about 3 mm, a height of between about 10 mm and about 15 mm, and a radius of curvature of about 30 mm. In the example of step-profile supports, the supports have a thickness of about 2 mm, a width of about 2 cm, a height of about 1.5 cm, a rise of about 5 mm, and a run of between about 5 mm and about 15 mm.

In some implementations, the deck assembly includes or defines a heel cup configured to receive the heel of a foot and at least one substantially U-shaped strike force redirector. The heel cup has right and left portions. The strike force redirector has a base and right and left legs secured to the respective right and left portions of the heel cup substantially near respective right and left lateral edges of the heel cup. The deck includes two strike force redirectors disposed parallel to each other; however, any number of strike force redirectors may be used. The strike force redirector translates any ground contact forces, incurred by the heel portion 212 of the outsole 210 and therefore the base, through its right and left legs to the lateral edges of the heel cup. The strike force redirector may be curved, step-profiled, straight, or any other suitable shape or geometry.

FIGS. 5A-5M show another implementation of the sole assembly 200, 200C with a deck assembly 300C disposed on the outsole 210 in the heel portion 202C of the sole assembly 200C, substantially in between the outsole 210 and a midsole 220C. A lower deck portion 320C rests on the outsole 210, and the midsole 220C defines a receiver or contour 223C configured to receive the deck assembly 300C. In the example shown in FIG. 5E, the toeward portion 317C of an upper deck portion 310C is unsupported along a forward edge 318C; however, in other examples the toeward portion 317C of the upper deck portion 310C is at least partially supported by the outsole 210.

The heelward portion 319C of the upper deck portion 310C is shown supported by a rear support 350C joined to the lower deck portion 320C. In some examples, the lower deck portion 320C gradually transitions into the rear support 350C, forming a gentle curve. In other examples, the heelward portion 319C of the upper deck portion 310C is either unsupported or at least partially supported by the outsole 210.

Figure 5K:
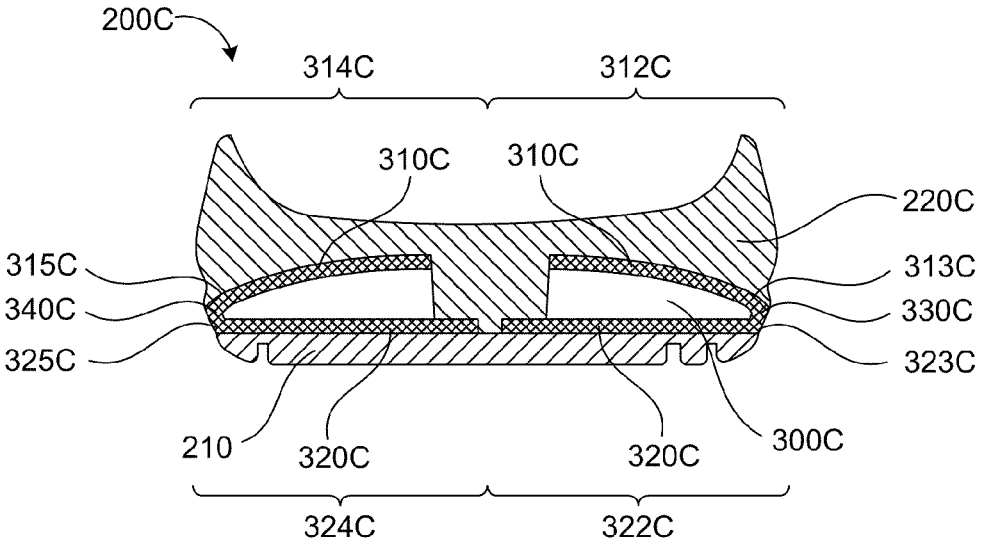
FIG. 5K is a section view of the sole assembly of FIG. 5F along line 5K-5K.

Referring to FIG. 5K, the upper deck portion 310C has right and left portions 312C, 314C, which have corresponding right and left lateral edges 313C, 315C. The lower deck portion 320C has right and left portions 322C, 324C, which have corresponding right and left lateral edges 323C, 325C. The deck assembly 300C includes right and left supports 330C, 340C attached to the respective right and left portions 312C, 314C of the upper deck portion 310C and to the respective right and left portions 322C, 324C of the lower deck portion 320C. In some implementations, the right and left supports 330C, 340C are attached to the upper and lower deck portions 310C, 320C substantially near the respective right and left lateral edges 313C, 315C of the upper deck portion 310C and the respective right and left lateral edges 323C, 325C of the lower deck portion 320C. The right and left supports 330C, 340C may be sufficiently small so as to appear as through the upper and lower deck portions 310C, 320C extend from one another.

Figure 5L:
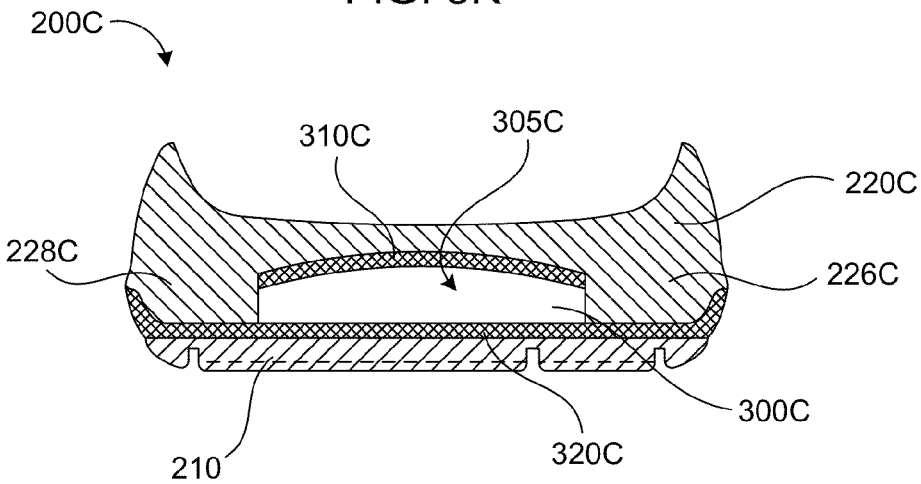
FIG. 5L is a section view of the sole assembly of FIG. 5F along line 5L-5L.
Figure 5M:
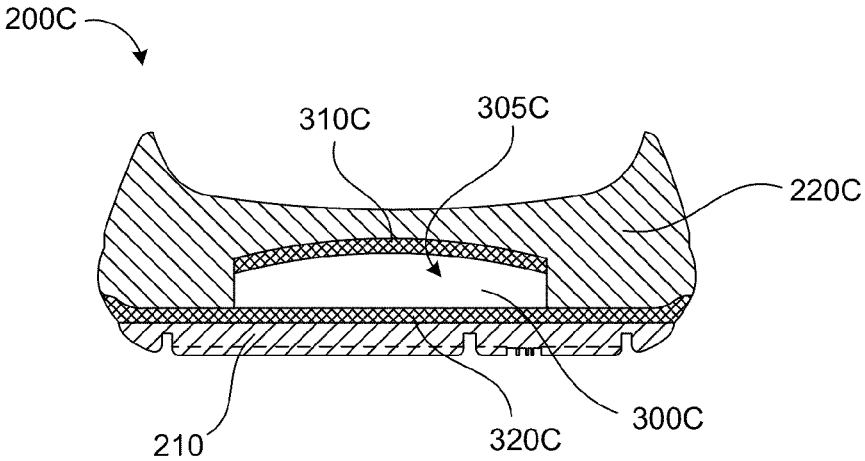
FIG. 5M is a section view of the sole assembly of FIG. 5F along line 5M-5M.

Referring to the example shown in FIG. 5L, the upper deck portion 310C defines an arcuate shape, preferably upwardly convex, which facilitates the translation of downward heel forces laterally outward. Similarly, in some examples, the lower deck portion 320C defines an arcuate shape, preferably downwardly convex, so that forces incurred near the center of the heel portion 212C of the outsole 210C are redirected by the deck 300C laterally outward, thus minimizing any forces experienced by the heel of a user's foot. A cavity 305C is defined between the upper and lower deck portions 310C, 320C. In the example shown, the midsole 220C defines or includes right and left side supports 226C, 228C that provide direct support from the heel portion 212C of the outsole 210 to the heel of a received foot, thus supplementing the support provided by the deck 300C. The right and left side supports

226C, 228C are positioned substantially near the respective right and left lateral edges 313C, 315C of the upper deck portion 310C and the respective right and left lateral edges 323C, 325C of the lower deck portion 320C to aid force translation along a perimeter of the heel portion 202C of the sole assembly 200C (e.g., to prevent force translation directly vertically downward).

In some implementations, the heel portion 202C of the sole assembly 200C extends between about 8 mm and about 13 mm heelwardly past a heel portion 114 of the upper 110. This heelward extending portion aids stability of the user and helps prevent rocking backward over the user's heel.

While standing on a moving surface (e.g. boat deck), a person's ability to press his/her toes downwardly against the surface affects that person's stability on the moving surface. In some implementations, the shoe 100 includes a toe box portion 130 configured to allow a user to easily press one or more of his/her toes downwardly against a supporting surface. The shoe 100 defines a toe spring of between about 1 mm and about 20 mm, preferably about 15 mm, to bring the toes of a user within close proximity of the supporting surface and prevent forward rocking exhibited by shoes with greater toe springs (e.g. as with typical running shoes). As a result, this toe spring is not a mere cosmetic design choice, but instead, is chosen to provide a specific level of shoe stability suitable for standing on moving surfaces (e.g. as with boating). Generally, shoe designers select a toe spring that is typically considered aesthetically pleasing. However, this larger toe spring lends the shoe to forward rocking and increases the distance user must flex his/her toes downwardly to increase stability. An upper portion 132 of the toe box portion 130 is constructed of one or more flexible materials to allow easy flexion of the toe box portion 130 upwardly and downwardly. Again, a user's ability to easily flex his/her toes downwardly increases stability and prevents rocking.

Figure 6A:
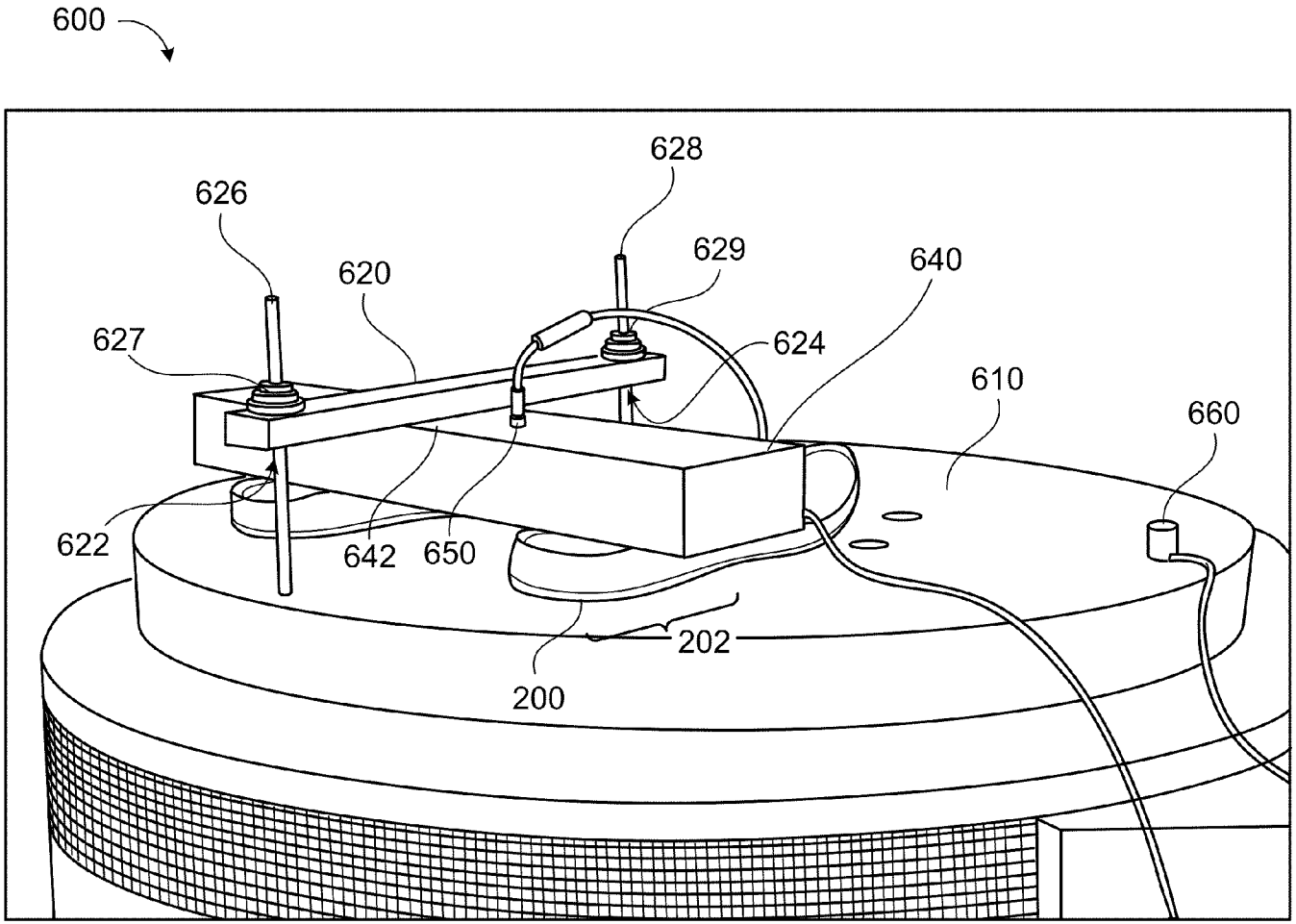
FIG. 6A is a perspective view of a testing apparatus for a sole assembly.
Figure 6B:
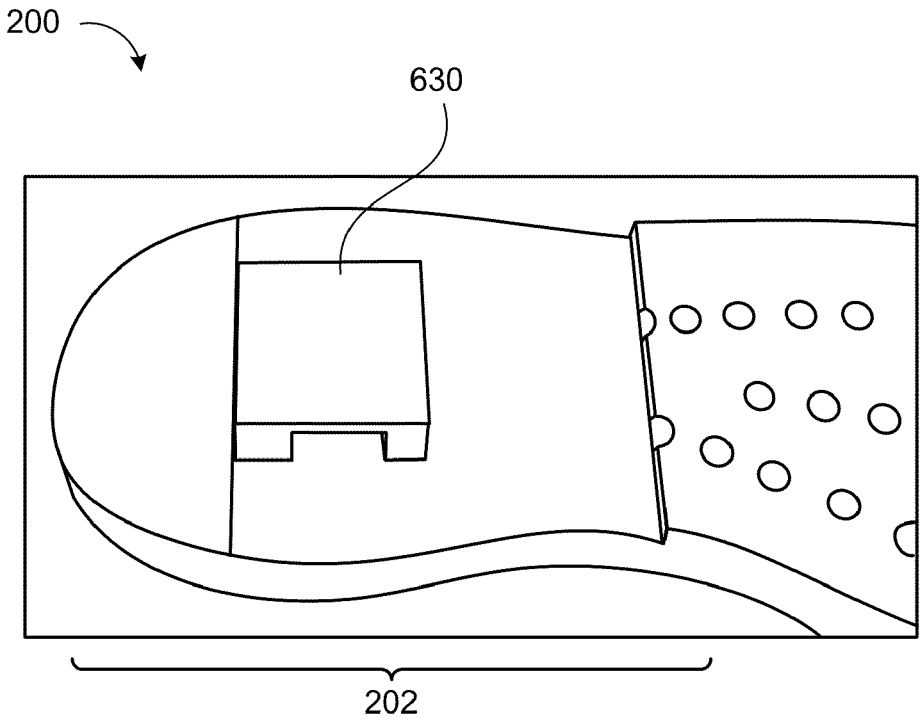
FIG. 6B is a top perspective view of a sole assembly with a testing block placed on the heel portion thereof.

The shock and vibration absorption properties of individual materials and/or constructed shoes may be measured using the following testing procedure. Referring to FIGS. 6A and 6B, a shaker table 600 is equipped with a base fixture plate 610 having, for example, a diameter of about 30 inches (762 mm) and a thickness of about 2 inches (51 mm) (e.g., made of 50-52 Aluminum). A cross bar 620 (e.g., having length of about 348 mm, a width of about 39 mm, and a thickness of about 19.5 mm) defines first and second apertures 622, 624 for receiving respective first and second cross bar rods 626, 628 (e.g., ⅜ inch (9.5 mm) diameter, 16 course thread) to attach the cross bar 620 to the base fixture plate 610. At least sole assembly 200 is placed on the base fixture plate 610. The at least sole assembly 200 should be conditioned to the temperature and humidity of the testing facility by bringing them to the testing facility at least 24 hrs prior to testing.

In the example shown, right and left sole assemblies 200 are placed on the base fixture plate 610. A heel block 630 (e.g., an aluminum block having a length of about 38 mm, a width of about 38 mm, and a thickness of about 26 mm high) is used to simulate the heel bone and is placed substantially centered on the heel portion 202 of each sole assembly 200 with a rearward edge located a distance D of about 15% an overall length L of the sole assembly 200. A weight 640 (e.g., steel bar having length of 465 mm, width of 100 mm, and height of 50.5 mm and weighing 42 lbs (19 kg)) is placed over the heel block 630 in the heel portion 202 of each sole assembly 200. The cross bar 620 secures the weight 640 in place. Nuts 627, 629 are tightened on the respective threaded cross bar rods 626, 628 to 1 in-lb for shock testing and 10 in-lb for vibration testing. A rubber pad 642 having a thickness of about ¼ inch (6.35 mm), a durometer of between about 50 and about 55 Shore A, a length of 100 mm and a width of about 39 mm is inserted between cross bar 620 and the weight 640 to deaden any ringing generated there between. A monitor accelerometer 650 is disposed on the weight 640 (e.g., about 1 inch (25.4 mm)) from the cross bar 620, which is centered width-wise on the weight 640. The monitor accelerometer 650 measure shock and vibrations that a supposed user of the sole assembly 200 would experience. A control accelerometer 660 is disposed on the base fixture plate 610 for measuring the actual input shocks and vibrations (in g's) delivered by the shaker table 600.

A minimum of 5 test repetitions at least 2 hours apart and on at least 2 different days should be executed to acquire data. In addition, "control samples" should be the first and last samples tested each day. Control samples are a predetermined group of items, generally selected towards the beginning of the project (3-5 samples is reasonable). Often, these "controls" are the project benchmarks, most relevant items, or the best performing sample(s) (can be shoes, materials, or assembled parts). Check that "control" results are similar through the course of day and from one day to the next.

Shock testing includes performing sine shock pulses on the shaker table 600 as follows (all with 10 ms durations): 1 g pulse, then re-torque the nuts 627, 629; 3 g pulse, then re-torque the nuts 627, 629; and 5 g pulse, then re-torque the nuts 627, 629. Vibration testing includes performing a half-sine sweep 5-200 Hz at 0.5 g's at 1 octave per minute on the shaker table 600. Signals of the monitor accelerometer 650 and the control accelerometer 660 are recorded during execution of the testing.

Figure 7:
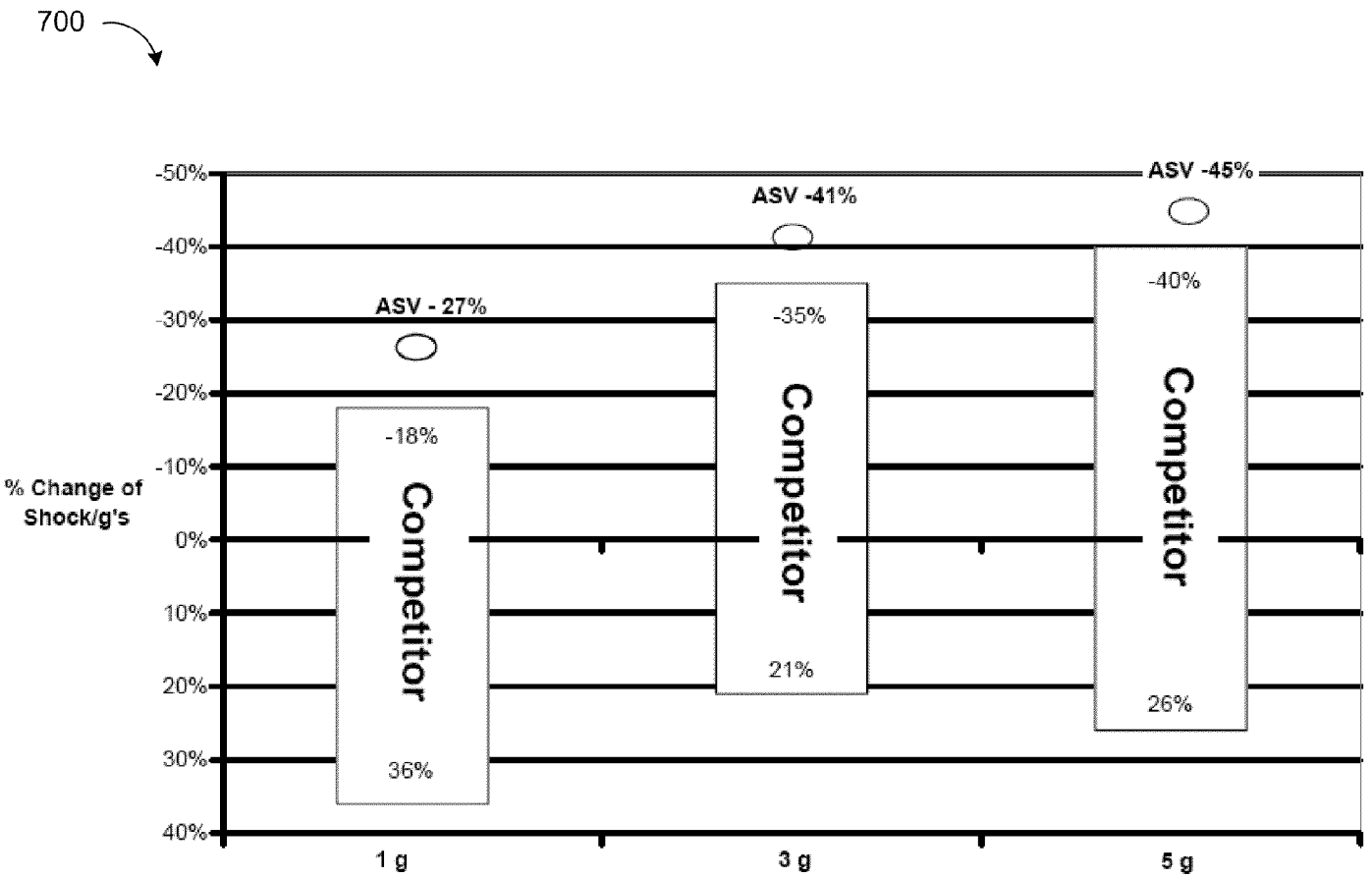
FIG. 7 is a chart providing exemplary shock reduction data for a shoe having a deck assembly as compared to other shoes without a deck assembly.

FIG. 7 provides an exemplary chart 700 illustrating shock testing results on a shoe 100 having a deck assembly 300 and a number of shoes without the deck assembly 300. While shock testing with a sine shock pulse at 1 g, the shoe 100 (ASV) provided a 27% reduction in the shock wave transmitted to a user's heel relative to wearing no shoe, while shoes without the deck assembly 300 provided between an 18% reduction and a 36% amplification of the shock wave. While shock testing with a sine shock pulse at 2 g's, the shoe 100 (ASV) provided a 41% reduction in the shock wave transmitted to a user's heel relative to wearing no shoe, while shoes without the deck assembly 300 provided between an 35% reduction and a 21% amplification of the shock wave. While shock testing with a sine shock pulse at 3 g's, the shoe 100 (ASV) provided a 45% reduction in the shock wave transmitted to a user's heel relative to wearing no shoe, while shoes without the deck assembly 300 provided between an 40% reduction and a 26% amplification of the shock wave. Table 1 below provides summary of shock testing results across a number of shoes. ASV Shoe includes the deck assembly 300.

TABLE 1

| Shoe | Δ 1 g | % Change over input | Δ 3 g | % Change over input | Δ 5 g | % Change over input |
|---|---|---|---|---|---|---|
| ASV Shoe | −0.34 | −27% | −1.21 | −41% | −2.33 | −45% |
| Rockport XCS Nausori | −0.24 | −18% | −0.98 | −34% | −2.05 | −40% |
| Merrell Waterpro | −0.2 | −16% | −1.01 | −35% | −2.04 | −39% |
| Nike Shox | −0.17 | −13% | −1.01 | −35% | −2.06 | −40% |
| NB Zip (Grey) | −0.15 | −12% | −0.95 | −33% | −2.02 | −39% |
| NB Athletic | −0.15 | −12% | −0.82 | −28% | −1.86 | −36% |
| Adidas Microbounce | −0.14 | −11% | −0.95 | −33% | −1.95 | −38% |
| Puma Jago | −0.11 | −8% | −0.85 | −29% | −1.51 | −30% |
| Rugged Shark Aquaire Pro | −0.09 | −7% | −0.64 | −22% | −1.16 | −23% |
| Cole Haan Aire Everett | −0.09 | −7% | −0.61 | −21% | −0.8 | −15% |

TABLE 1-continued

| Shoe | Δ 1 g | % Change over input | Δ 3 g | % Change over input | Δ 5 g | % Change over input |
|---|---|---|---|---|---|---|
| Clarks Zarkon | −0.09 | −7% | −0.76 | −26% | −1.54 | −30% |
| Crocs | −0.07 | −5% | −0.87 | −30% | −1.89 | −37% |
| Mizuno Wave | −0.05 | −4% | −0.86 | −30% | −1.94 | −37% |
| Puma Decker | −0.03 | −3% | −0.69 | −24% | −1.43 | −28% |
| Nike Air | −0.03 | −3% | −0.84 | −29% | −1.71 | −33% |
| Salomon Tech Amphibian | −0.02 | −2% | −0.79 | −27% | −1.97 | −38% |
| Helly Hansen Hydrator | 0.008 | 1% | −0.34 | −12% | −0.56 | −11% |
| Salomon Karma | 0.02 | 2% | −0.56 | −19% | −1.31 | −26% |
| CMEVA Adidas | 0.028 | 2% | −0.46 | −16% | −1.14 | −22% |
| Sebago Clovehitch | 0.032 | 2% | −0.66 | −23% | −1.72 | −34% |
| Sebago Spinnaker | 0.464 | 36% | 0.61 | 21% | 1.31 | 26% |

Across all of the shoes tested the ASV shoe having the deck assembly 300 provided the greatest reduction in shock transmission to a user.

A number of implementations have been described. Nevertheless, it will be understood that various modifications may be made without departing from the spirit and scope of the disclosure. Accordingly, other implementations are within the scope of the following claims.

What is claimed is:

1. An article of footwear comprising:

a footwear upper; and a sole assembly secured to the footwear upper, the sole assembly having a heelward portion and a toeward portion, the sole assembly comprising:

an outsole;

a first midsole disposed on the outsole in at least the toeward portion of the sole assembly, the first midsole having a bottom surface that defines a contour;

a heel insert disposed in an aperture of the first midsole to receive a heel of a user; and a deck assembly disposed on the outsole in at least the heelward portion of the sole assembly substantially between the outsole and the first midsole and being disposed at least partially within the contour on the bottom surface of the first midsole, the deck assembly comprising:

an upper deck portion;

a lower deck portion spaced from the upper deck portion; and right and left supports attached to respective right and left portions of the upper and lower deck portions substantially near respective right and left lateral edges of the upper and lower deck portions;

wherein the deck assembly defines a cavity between the upper and lower deck portions, the deck assembly directing translation of ground contact forces incurred by the heelward portion of the sole assembly at least partially laterally outwardly.

2. The article of footwear of claim 1, wherein the right and left supports are attached to the respective right and left portions of the upper deck portion substantially near a toeward portion of the upper deck portion.

3. The article of footwear of claim 1, wherein the outsole is configured to support at least a portion of the right and left portions of the upper deck portion substantially near the respective right and left lateral edges of the upper deck portion.

4. The article of footwear of claim 1, wherein the sole assembly further comprises a second midsole disposed between the upper and lower deck portions substantially about the cavity defined therebetween.

5. The article of footwear of claim 4, wherein the second midsole is more compliant than the first midsole.

6. The article of footwear of claim 1, wherein the first midsole comprises at least one of a shock absorbing polyurethane and ethylene vinyl acetate.

7. The article of footwear of claim 1, wherein the deck assembly further comprises a rear support attached to a heelward portion of the upper deck portion and a heelward portion of the lower deck portion.

8. The article of footwear of claim 1, wherein the upper deck portion defines an arcuate shape.

9. The article of footwear of claim 1, wherein the right and left supports define curved shapes.

10. The article of footwear of claim 1, wherein the right and left supports define substantially step-profiled shapes.

11. The article of footwear of claim 1, wherein the deck assembly comprises a thermoplastic polyurethane.

12. The article of footwear of claim 1, wherein the article of footwear defines a toe spring of between about 1 mm and about 20 mm.

13. The article of footwear of claim 1, wherein the sole assembly further comprises an outsole defining a siped bottom surface, the outsole supporting the deck assembly.

14. The article of footwear of claim 13, wherein the outsole comprises at least one of isobutylene rubber, butadiene rubber, styrene butadiene rubber and natural rubber.

15. A sole assembly for an article of footwear, the sole assembly comprising:

an outsole having a heelward portion and a toeward portion;

a first midsole disposed on the outsole in at least the toeward portion of the outsole, the first midsole having a bottom surface that defines a contour;

a heel insert disposed in an aperture of the first midsole to receive a heel of a user; and a deck assembly disposed in a heelward portion of the sole assembly between the outsole and the first midsole, the deck assembly being disposed at least partially within the contour on the bottom surface of the first midsole, the deck assembly comprising:

upper and lower deck portions; and a second midsole disposed between the upper and lower deck portions, the second midsole defining a cavity for substantially inhibiting translation of ground contact forces directly between the upper and lower deck portions, the second midsole at least partially supporting the upper deck portion.

16. The sole assembly of claim 15, further comprising right and left supports attached to respective right and left portions of the upper and lower deck portions substantially near respective right and left lateral edges of the upper and lower deck portions.

17. The sole assembly of claim 16, wherein the right and left supports are attached to the respective right and left portions of the upper and lower deck portions substantially near respective toeward portions of the upper and lower deck portions.

18. The sole assembly of claim 15, wherein the deck assembly further comprises a rear support attached to a heelward portion of the upper deck portion and a heelward portion of the lower deck portion.

19. The sole assembly of claim 15, wherein the second midsole is more compliant than the first midsole.

20. The sole assembly of claim 15, wherein the first midsole comprises at least one of a shock absorbing polyurethane and ethylene vinyl acetate.

21. The sole assembly of claim 15, wherein the deck assembly comprises a thermoplastic polyurethane.

* * * * *